US010827833B2

(12) United States Patent
Romantic et al.

(10) Patent No.: US 10,827,833 B2
(45) Date of Patent: Nov. 10, 2020

(54) CABINET WITH TILTABLE WIRE SHELF AND BIN EXCHANGE SYSTEM

(71) Applicant: INTERMETRO INDUSTRIES CORPORATION, Wilkes-Barre, PA (US)

(72) Inventors: Timothy William Romantic, Drums, PA (US); Robert R. Steele, Sweet Valley, PA (US); David A. Reppert, Kingston, PA (US); Sushant Ramchandra Parekar, Pune (IN)

(73) Assignee: INTERMETRO INDUSTRIES CORPORATION, Wilkes-Barre, PA (US)

( * ) Notice: Subject to any disclaimer, the term of this patent is extended or adjusted under 35 U.S.C. 154(b) by 0 days.

(21) Appl. No.: 16/362,111

(22) Filed: Mar. 22, 2019

(65) Prior Publication Data

US 2020/0015586 A1 Jan. 16, 2020

(30) Foreign Application Priority Data

Mar. 22, 2018 (IN) ..... 201821010553

(51) Int. Cl.
*A47B 57/04* (2006.01)
*A47B 57/54* (2006.01)

(52) U.S. Cl.
CPC ..... *A47B 57/545* (2013.01); *A47B 57/04* (2013.01)

(58) Field of Classification Search
CPC ... A47B 96/024; A47B 96/021; A47B 96/068; A47B 57/545; A47B 57/04; A47B 57/40;
(Continued)

(56) References Cited

U.S. PATENT DOCUMENTS 1,280,114 A * 9/1918 Williams ..... A47B 57/16 108/110
3,601,432 A * 8/1971 Fenwick ..... A47B 57/40 403/230

(Continued)

FOREIGN PATENT DOCUMENTS

EP 3549489 * 10/2019
GB 342048 * 1/1931

(Continued)

OTHER PUBLICATIONS

Starsys Enclosed Units With Wire Shelves_Instructions for Use; circa. Jan. 2015.

*Primary Examiner* — Janet M Wilkens
(74) *Attorney, Agent, or Firm* — Harness, Dickey & Pierce, P.L.C.

(57) ABSTRACT

A cabinet assembly includes a cabinet body, a tiltable wire shelf, and a shelf mounting system. The cabinet body has a base, a top, and a pair of sides that extend between the base and the top to define an inner volume. The tiltable wire shelf is mounted in the inner volume of the cabinet body and includes a front bar, a rear bar, a pair of side bars, and a plurality of crossbars. The shelf mounting system supports the tiltable wire shelf on the cabinet body and comprises a pivot coupling between the cabinet body and the front or rear bar of the tiltable wire shelf, and a sliding coupling between the cabinet body and one of the side bars of the tiltable wire shelf. The couplings cooperate to provide tiltable adjustment of the tiltable wire shelf relative to the cabinet body over a range of angles.

16 Claims, 18 Drawing Sheets

(58) Field of Classification Search
CPC ..... A47B 57/20; A47B 57/26; A47B 57/16; A47B 47/0083; A47F 5/0037; A47F 5/12; A47F 5/16; A47F 5/101; A47F 5/0876; A47F 2005/165; A47F 1/12; Y10T 403/7094; F16B 5/0052
USPC ..... 312/351, 408, 35, 72; 211/175, 187, 211/90.03, 90.02, 190, 103, 134, 150, 211/90.04; 108/106, 107, 109, 110, 60, 108/61; 248/221.3, 222.1, 220.21, 224.8, 248/225.11, 225.21; 403/381
See application file for complete search history.

(56) References Cited

U.S. PATENT DOCUMENTS 4,790,707 A * 12/1988 Magretta ..... A47B 57/402 211/187
5,415,302 A * 5/1995 Carlson ..... A47B 55/02 108/147.13
5,531,167 A * 7/1996 Stevens ..... A47B 55/02 108/106
5,645,182 A * 7/1997 Miller, Jr. ..... A47F 1/12 108/107
7,533,948 B2 * 5/2009 Smith ..... A47B 55/02 108/107
10,165,854 B2 * 1/2019 Lim ..... F16B 12/34
2006/0042522 A1 * 3/2006 Trubiano ..... A47B 57/10 108/110
2006/0076304 A1 * 4/2006 Kainuma ..... A47F 5/0043 211/90.01
2016/0331128 A1 * 11/2016 Chuang ..... A47B 88/90

FOREIGN PATENT DOCUMENTS

WO 0016658 * 3/2000
WO 2011000432 * 1/2011
WO 2011030320 * 3/2011
WO 2016153449 * 9/2016

* cited by examiner

CABINET WITH TILTABLE WIRE SHELF AND BIN EXCHANGE SYSTEM

CROSS-REFERENCE TO RELATED APPLICATIONS

This application claims the benefit of Indian Provisional Patent Application No. 201821010553, filed on Mar. 22, 2018. The entire disclosure of the application referenced above is incorporated herein by reference.

FIELD

The present disclosure relates to storage cabinets and more particularly to modular storage cabinets with shelves configured to accommodate multiple storage bins.

BACKGROUND

The statements in this section merely provide background information related to the present disclosure and may not constitute prior art.

Modular storage cabinets allow users to configure the size and shelf arrangement of the storage cabinet to suit their needs. Modular storage cabinets typically allow users to adjust the number and height of the shelves in the storage cabinet, but not the angle of the shelves. In most modular storage cabinets, the shelves are designed to be horizontal (i.e., parallel to horizontal planes defined by the base and the top of the cabinet) rather than at an oblique angle relative to the horizontal planes of the base and the top of the cabinet.

SUMMARY

This section provides a general summary of the disclosure, and is not a comprehensive disclosure of its full scope or all of its features.

In accordance with one aspect of the subject disclosure, a cabinet assembly having a bin exchange system is described. The cabinet assembly includes a cabinet body having at least a base, a top, and a pair of sides. The pair of sides extend between the base and the top to define an inner volume. Each of the sides includes a front edge and a rear edge. The inner volume of the cabinet body is configured to receive one or more bins. Each bin has a bin height, a bin width, and a bin length. The bin height, bin width, and bin length are sized such that the bins fit inside the inner volume of the cabinet body. The cabinet assembly also includes one or more tiltable wire shelves mounted in the inner volume of the cabinet body. Each of the tiltable wire shelves includes a plurality of crossbars and a perimeter. The perimeter of each wire shelf includes a front bar, a rear bar, and a pair of side bars. The pair of side bars extend between the front and rear bars. Each of the side bars has a side bar length that is at least double the bin length such that at least two of the bins fit on each tiltable wire shelf between the front and rear bars in a front-to-back bin arrangement.

The cabinet assembly further includes a shelf mounting system that supports each of the tiltable wire shelves on the cabinet body. The shelf mounting system includes a pivot coupling disposed between the cabinet body and one of the front and rear bars of each tiltable wire shelf and a sliding coupling between the cabinet body and the pair of side bars of each tiltable wire shelf. The pivot coupling and the sliding coupling cooperate to provide tiltable adjustment of the at least one tiltable wire shelf relative to the cabinet body over a range of angles.

The shelf mounting system therefore gives users the flexibility of mounting one or more of the tiltable wire shelves in a horizontal orientation or at an oblique angle relative to the base and the top of the cabinet assembly. When the tiltable wire shelves are mounted at an oblique angle, the bins can be arranged such that a bin located towards the rear bar of the tiltable wire shelf slides forward under the influence of gravity when a bin located near the front bar of the tiltable wire shelf is removed from the cabinet body. This provides for an easy and convenient exchange of the bins in the cabinet assembly. The angle of the tiltable wire shelf can be adjusted over a wide range of angles to ensure that the user can adjust the rate at which the bins slide forward on the tiltable wire shelves. This is important because a bin may not slide forward at all if the angle is too small and the bin may slide past the front bar and fall out of the cabinet body if the angle is too large. The user can also optimize their view into the bins by adjusting the angle of the tiltable wire shelves.

Further areas of applicability and advantages will become apparent from the description provided herein. It should be understood that the description and specific examples are intended for purposes of illustration only and are not intended to limit the scope of the present disclosure.

BRIEF DESCRIPTION OF THE DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

The following description is merely exemplary in nature and is not intended to limit the present disclosure, application, or uses.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

Figure 4:
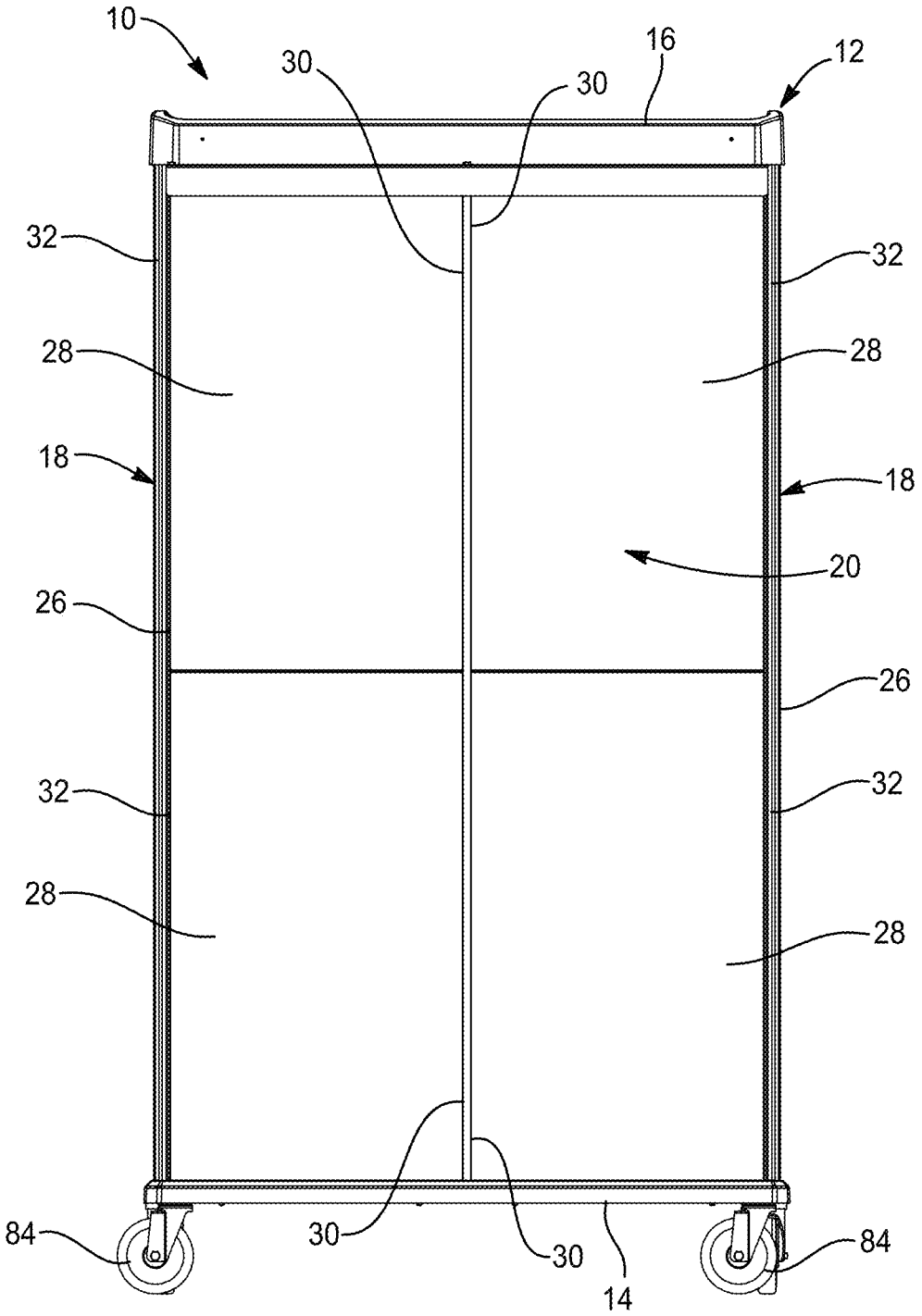
FIG. 4 is a rear elevation view of the exemplary cabinet assembly shown in FIG. 1.
Figure 5:
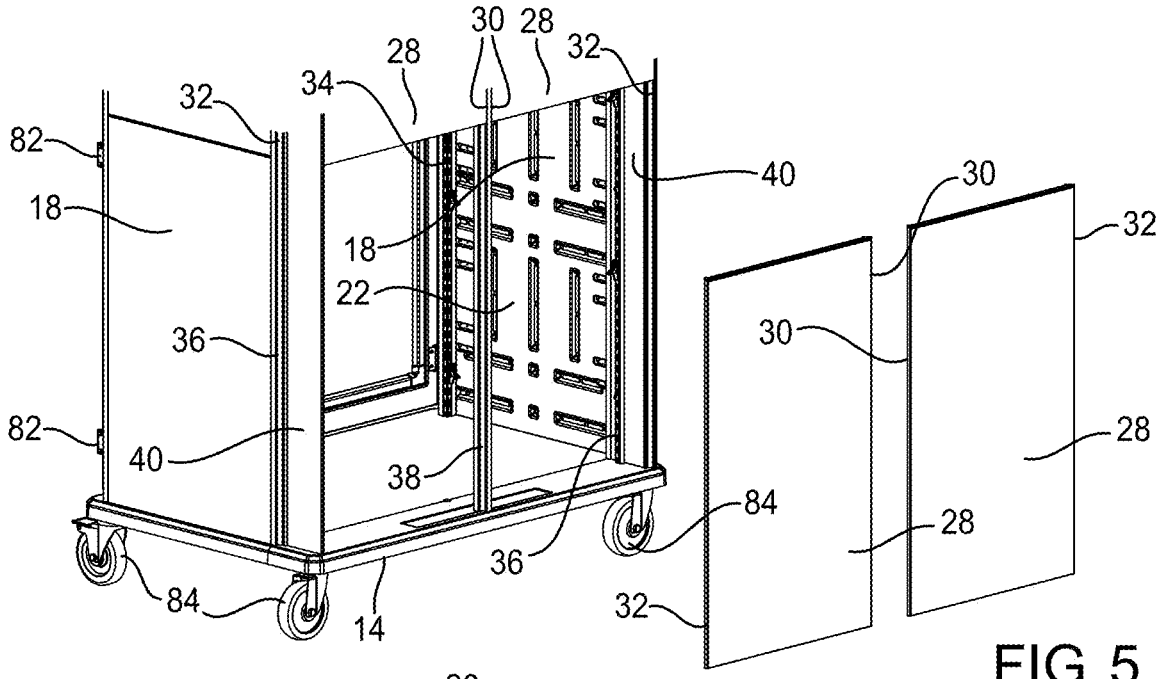
FIGS. 5, 6, and 7 are enlarged rear perspective views of the exemplary cabinet assembly shown in FIG. 1 with two of its rear panels exploded therefrom.
Figure 6:
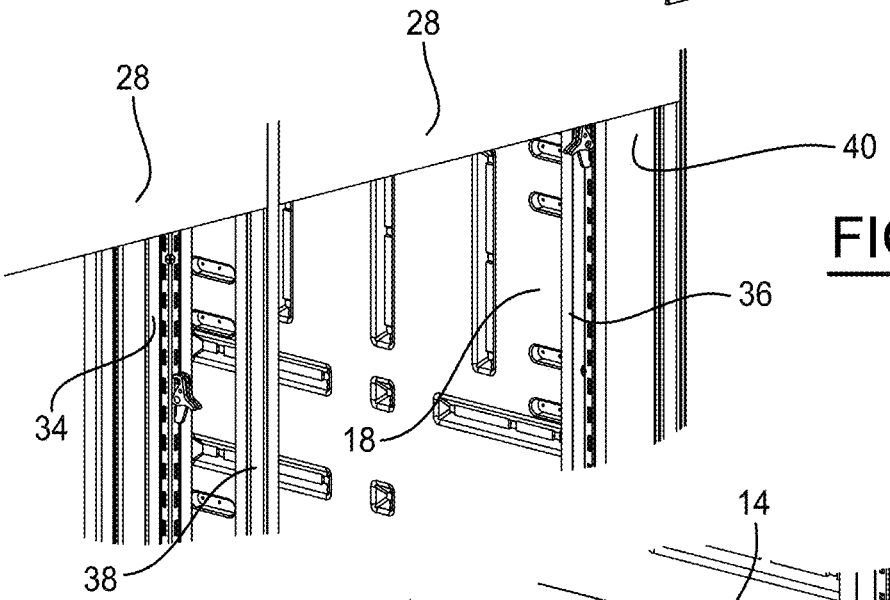
Figure 7:
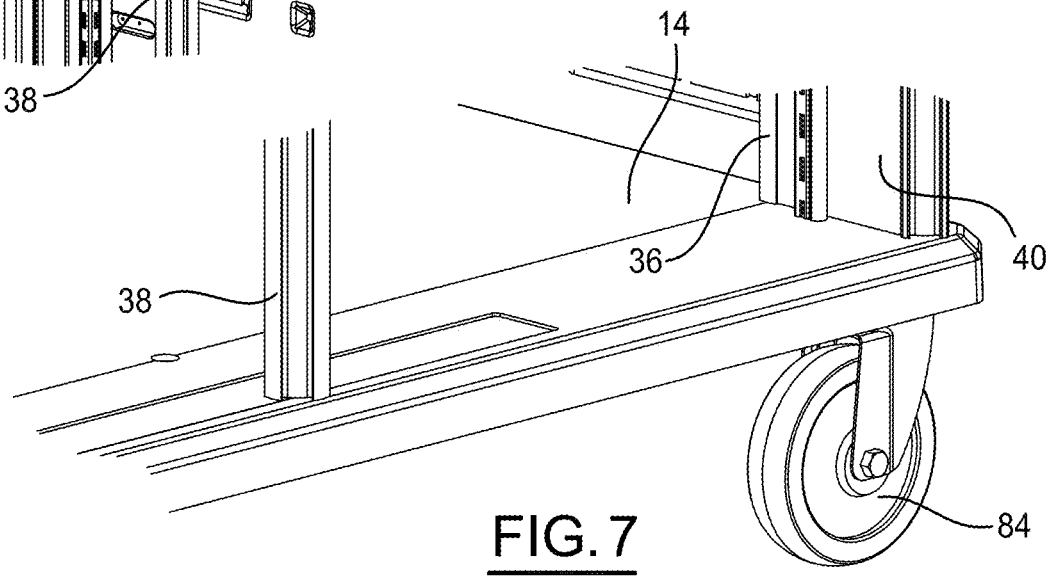
Figure 8:
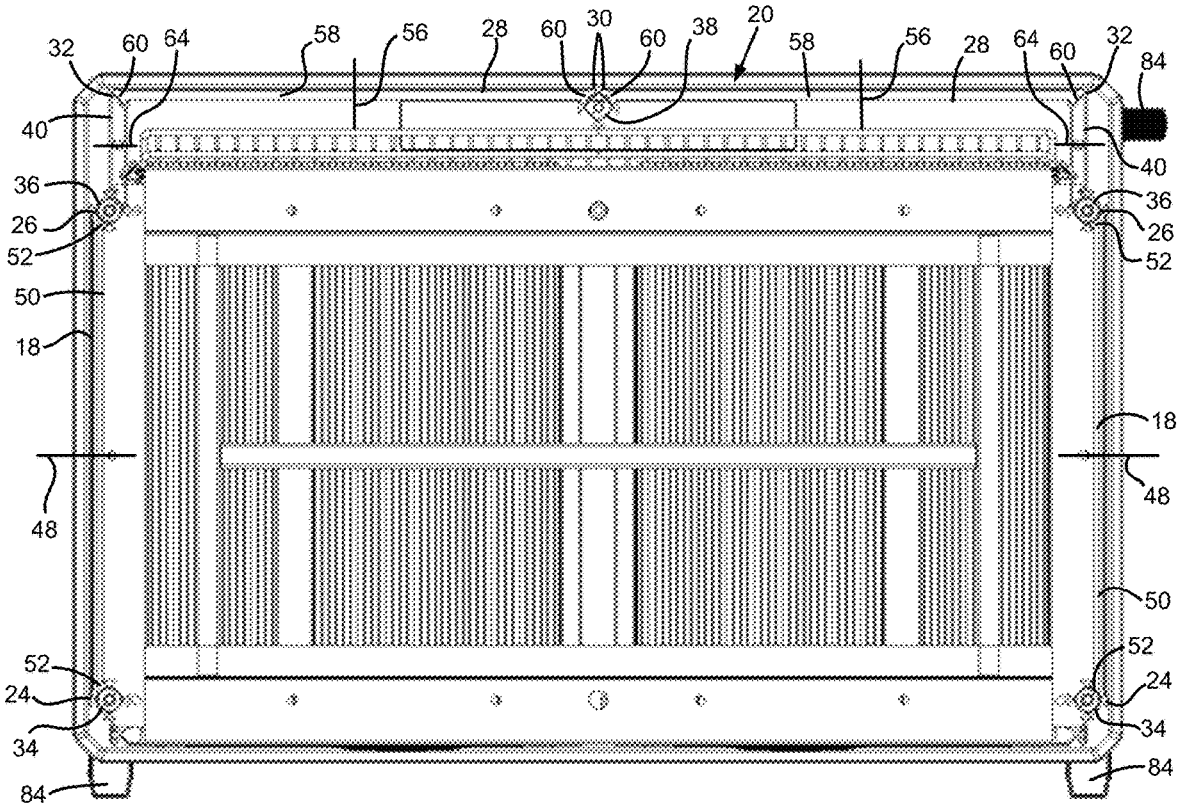
FIG. 8 is a top section view of the exemplary cabinet assembly shown in FIG. 1.
Figure 9:
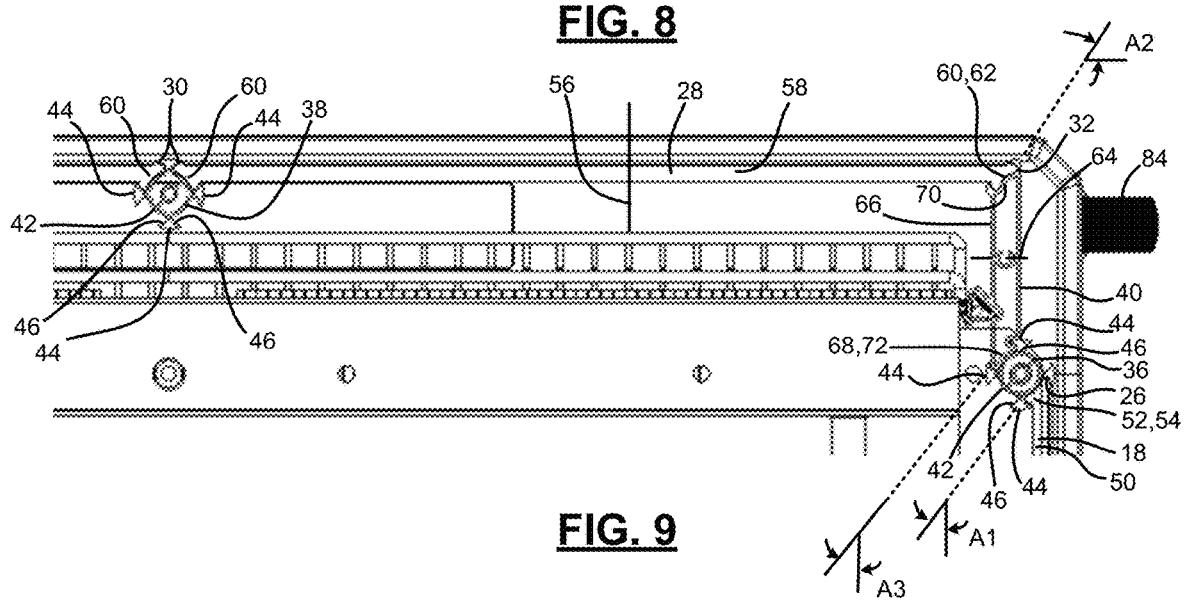
FIG. 9 is an enlarged top section view of the exemplary cabinet assembly shown in FIG. 1.
Figure 10:
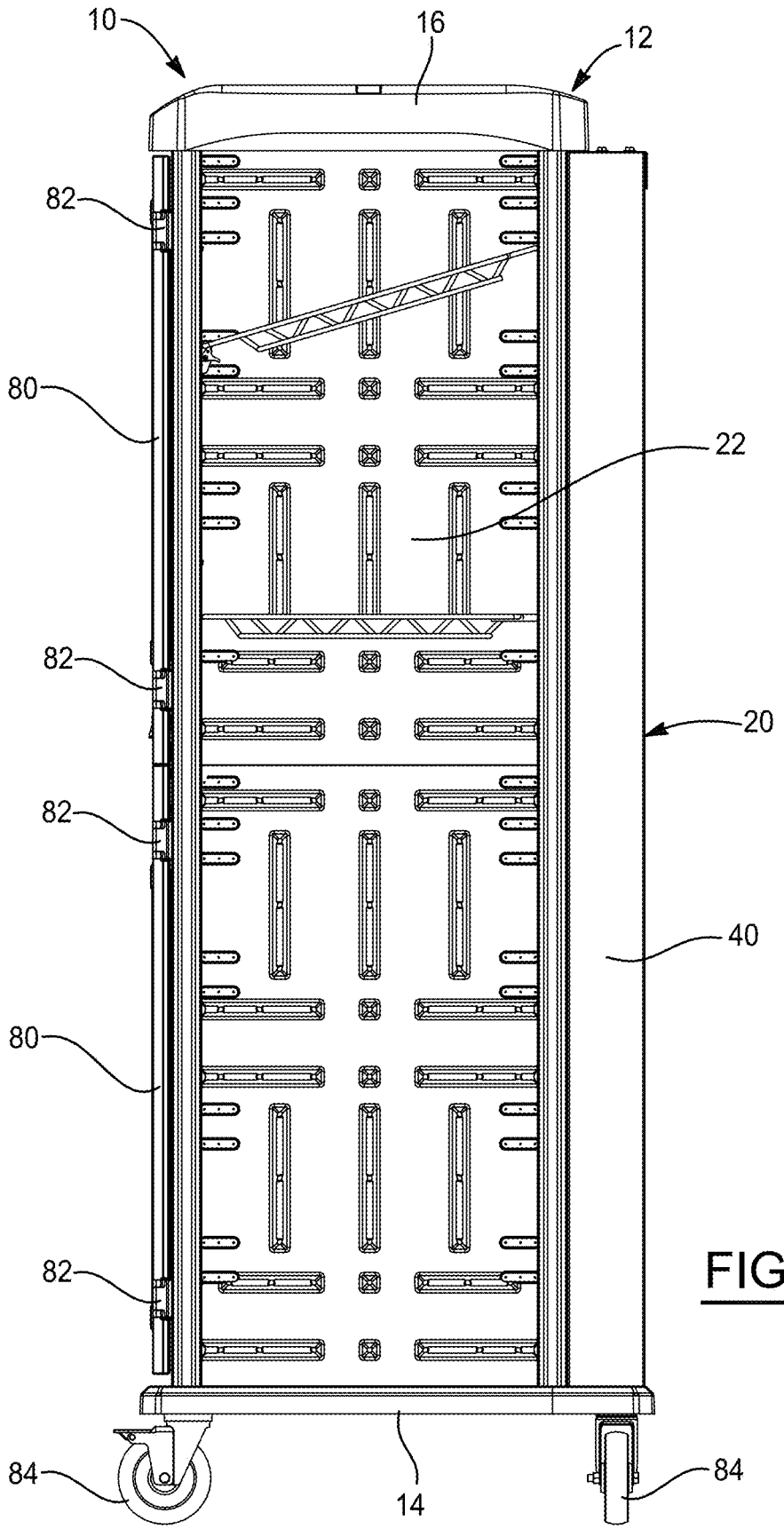
FIG. 10 is a side section view of the exemplary cabinet assembly shown in FIG. 1.

With reference to FIGS. 1-10 a cabinet assembly 10 with a bin exchange system is illustrated. The cabinet assembly 10 includes a cabinet body 12 having a base 14, a top 16, a pair of sides 18, and a rear wall 20. The pair of sides 18 extend between the base 14 and the top 16 to define an inner volume 22. Each of the sides 18 includes a front edge 24 and a rear edge 26. As shown in FIG. 4, the rear wall 20 includes one or more (e.g., four) rear panels 28 arranged in an upper pair and a lower pair. Each of the upper and lower pairs of the rear panels 28 are disposed adjacent to one another (e.g., side-by-side) in a direction extending between and perpendicular to the sides 18. Each of the rear panels 28 has an inner edge 30 and an outer edge 32.

As best shown in FIGS. 5-9, the cabinet body 12 further includes a pair of front corner posts 34, a pair of rear corner posts 36, a rear center post 38, and a pair of side extensions 40. Each front corner post 34 is arranged along and connected to the front edge 24 of one of the sides 18. Each rear corner post 36 is arranged along and connected to the rear edge 26 of one of the sides 18. The rear center post 38 is arranged along and connected to the inner edges 30 of the rear panels 28. Each side extension 40 extends between and connects the rear edge 26 of one of the sides 18 and the outer edge 32 of one of the rear panels 28. The front and rear corner posts 34 and 36 extend vertically between the base 14 and the top 16 and therefore act as a load bearing frame of the cabinet body 12. The rear center post 38 extends into the base 14 (e.g., the base 14 has a hole that receives the rear center post 38), and therefore the rear center post 38 contributes to the rigidity of the cabinet body 12.

The front corner posts 34, the rear corner posts 36, and the rear center post 38 are interchangeable. For example, the front corner posts 34, the rear corner posts 36, and the rear center post 38 may be structurally identical to one another, or at least structurally similar to one another, such that any one of the front corner posts 34, the rear corner posts 36, and the rear center post 38 may be used in place of any other one of the front corner posts 34, the rear corner posts 36, and the rear center post 38. Each of the front corner posts 34, the rear corner posts 36, and the rear center post 38 includes a cylindrical body 42 and two or more (e.g., four) ribs 44 projecting radially outward from the cylindrical body 42 to define curved channels 46 therebetween. One of the curved channels 46 of each front corner post 34 receives the front edge 24 of one of the sides 18. One of the curved channels 46 of each rear corner post 34 receives the rear edge 26 of one of the sides 18. Two of the curved channels 46 of the rear center post 38 receives the inner edges 30 one of the rear panels 28.

Each side 18 is symmetric with respect to a vertical plane 48 extending perpendicular thereto and parallel to the rear wall 20. Each side 18 includes a flat panel portion 50 and flange portions 52 disposed at the front and rear edges 24 and 26 thereof. The curved channels 46 in the front and rear corner posts 34 and 36 receive the flange portions 52 disposed at the front and rear edges 24 and 26 of the sides 18, respectively. Each flange portion 52 of each side 18 includes a curved wall 54 oriented at a first oblique angle A1 with respect to the flat panel portion 50 thereof.

Each rear panel 28 is symmetric with respect to a vertical plane 56 extending perpendicular thereto and parallel to the sides 18. Each rear panel 28 includes a flat panel portion 58 and flange portions 60 disposed at the inner and outer edges 30 and 32 thereof. The curved channels 46 in the rear center post 38 receive the flange portions 60 at the inner edges 30 of the rear panels 28. Each flange portion 54 of each rear panel 28 includes a curved wall 62 oriented at a second oblique angle A2 with respect to the flat panel portion 56 thereof.

Each side extension 40 is asymmetric with respect to a vertical plane 64 extending perpendicular thereto and parallel to the rear wall 20. Each side extension 40 includes a flat panel portion 66, a flange portion 68, and a coupling portion 70. Each flange portion 68 of each side extension 40 includes a curved wall 72 oriented at a third oblique angle A3 with respect to the flat panel portion 66 thereof. The first, second, and third oblique angles A1, A2, and A3 may be equal to one another. The coupling portion 70 of each side extension 40 defines a curved channel 74 that receives one of the flange portions 60 at the inner edges 30 of the rear panels 28.

Figure 11:
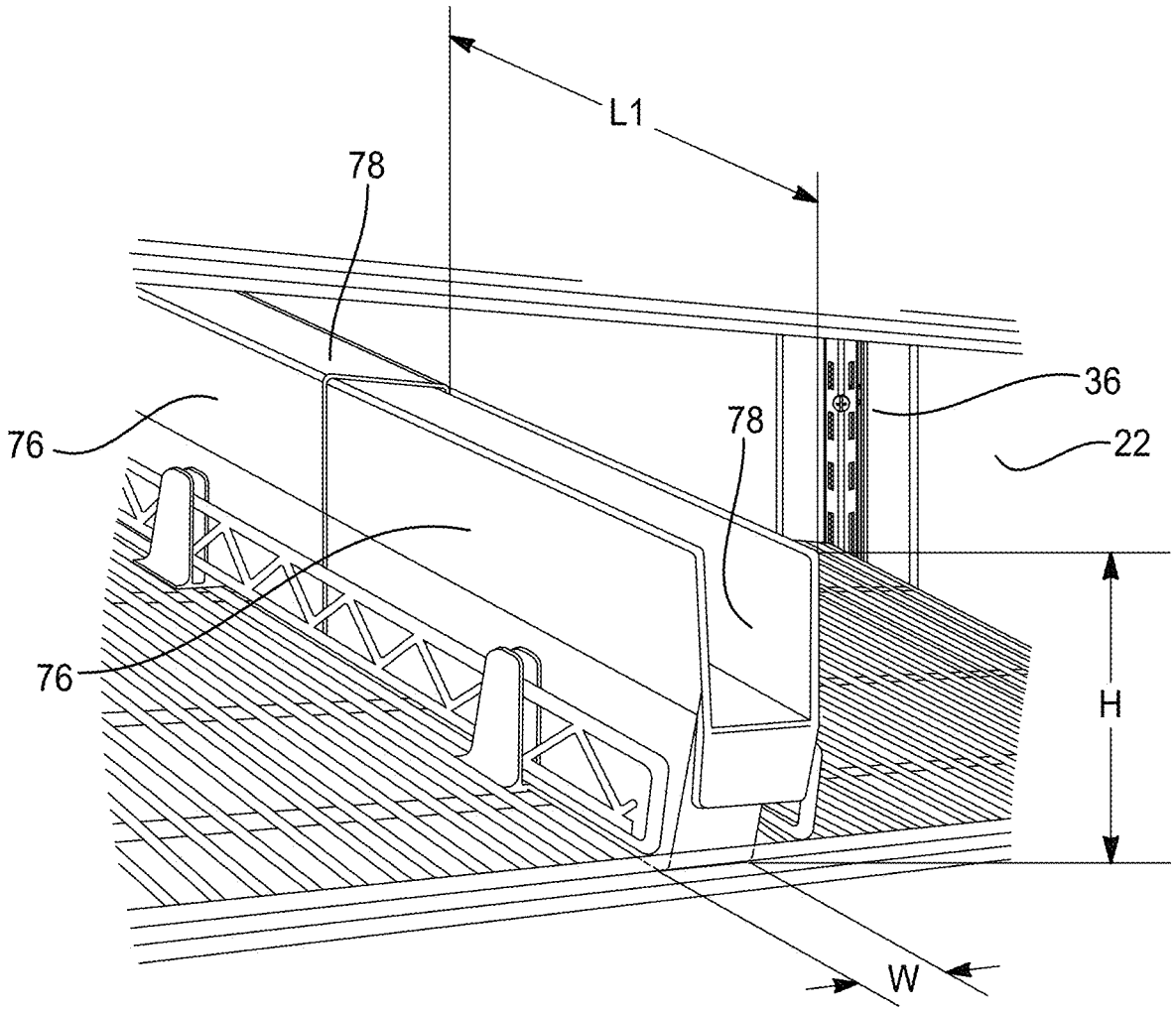
FIG. 11 is a front perspective view of an exemplary cabinet assembly similar to that shown in FIG. 1 with two bins disposed two deep on a tiltable wire shelf.

With additional reference to FIG. 11, the inner volume 22 of the cabinet body 12 is configured to receive one or more bins 76. Each bin has a bin height H, a bin width W, and a bin length L1. The bin height H, bin width W, and bin length L are sized such that the bins 76 fit inside the inner volume 22 of the cabinet body 12. Each bin 76 has at least one cavity 78 that is configured to receive one or more items for storage.

Figure 1:
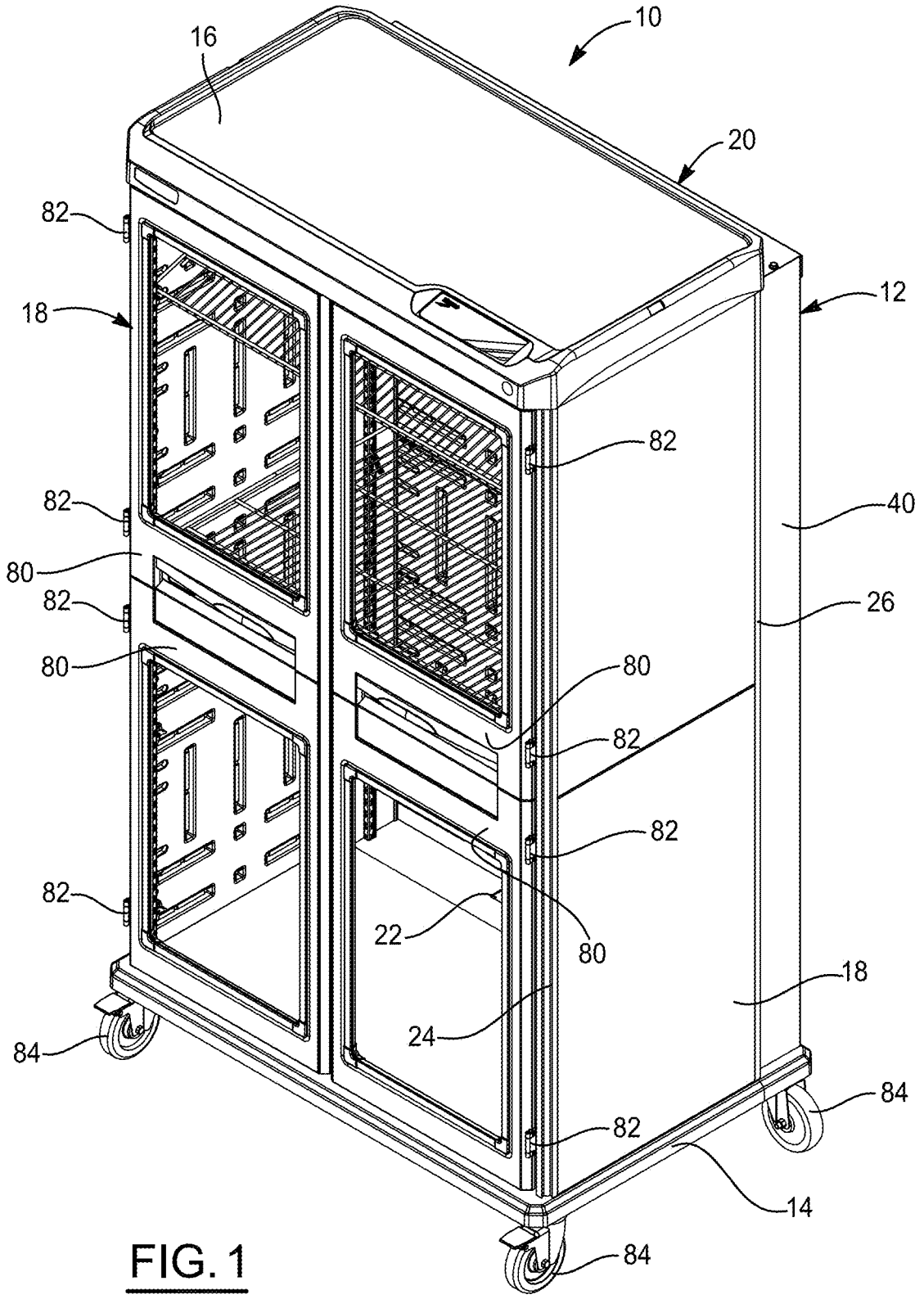
FIG. 1 is a front perspective view of an exemplary cabinet assembly constructed in accordance with the teachings of the present disclosure.
Figure 2:
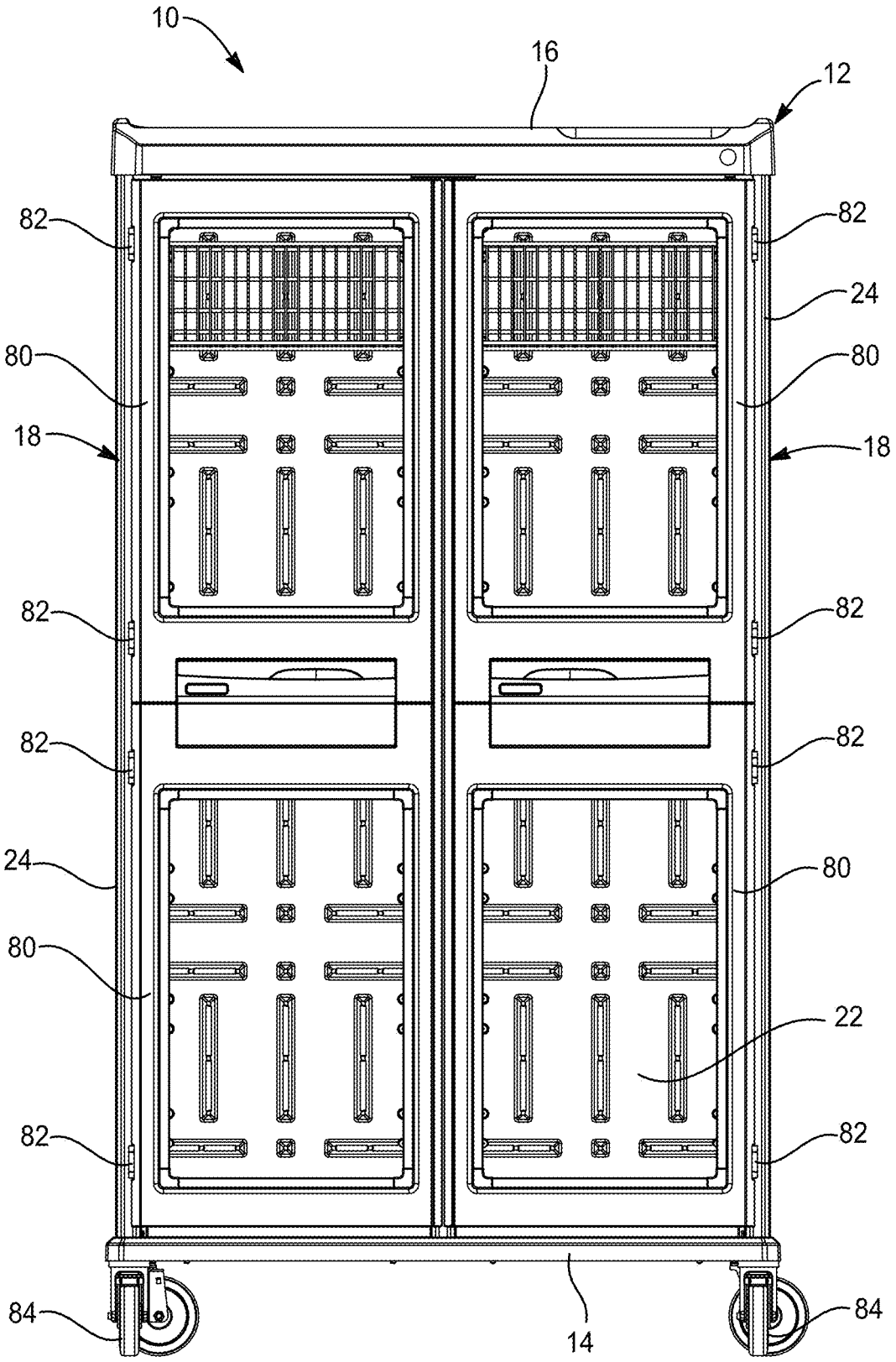
FIG. 2 is a front elevation view of the exemplary cabinet assembly shown in FIG. 1.
Figure 3:
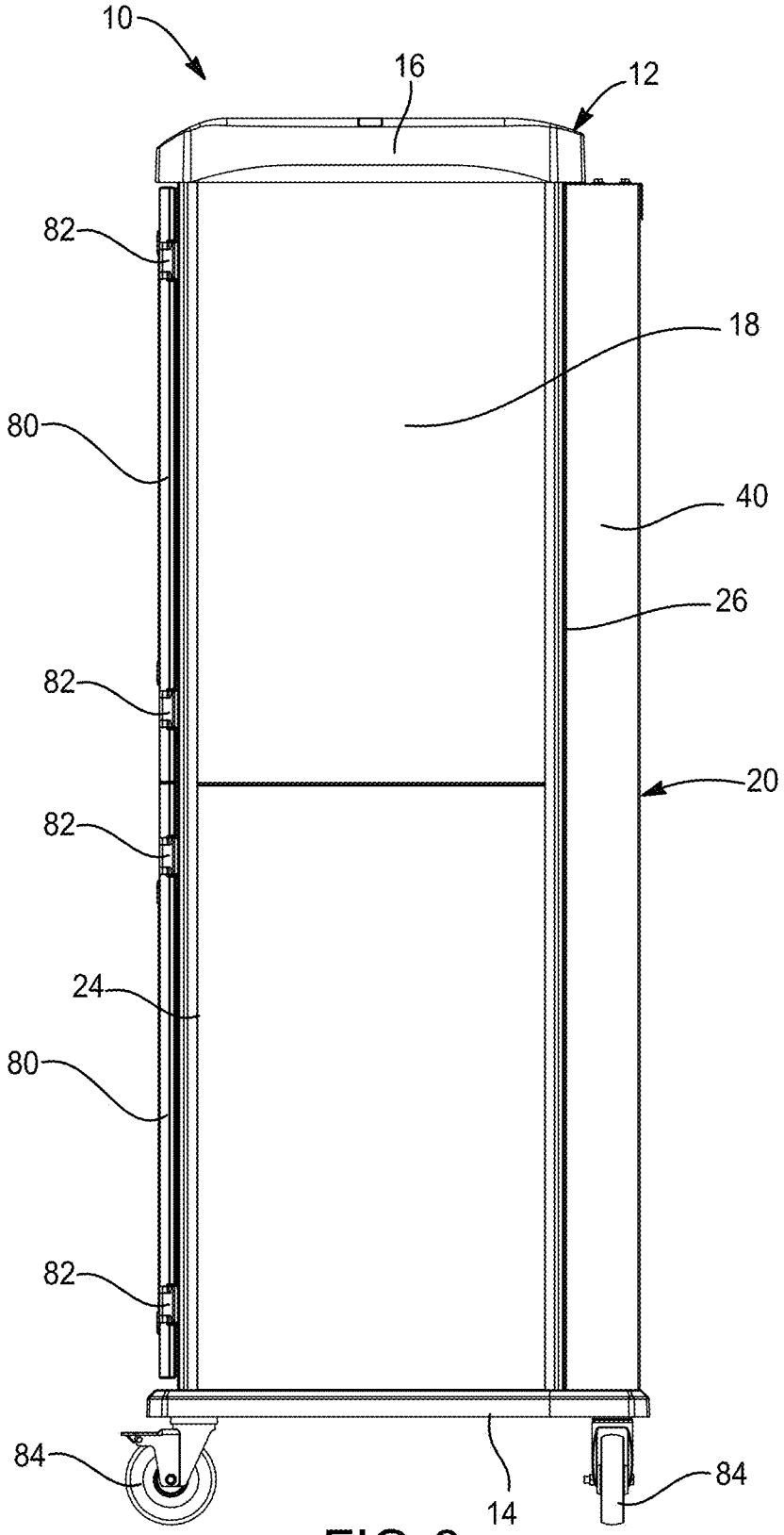
FIG. 3 is a side elevation view of the exemplary cabinet assembly shown in FIG. 1.

Optionally, the cabinet assembly may include one or more (e.g., four) doors 80 as shown in FIGS. 1 and 2. The doors 80 may be pivotally mounted to the cabinet body 12 by hinges 82 located along the front edges 24 of the sides 18. The hinges 82 may be connected to the pair of sides 18 and/or to the two front corner posts 34. Caster wheels 84 may optionally be mounted to the base 14, allowing the cabinet assembly 10 to be rolled from one location to a different location.

Figure 12:
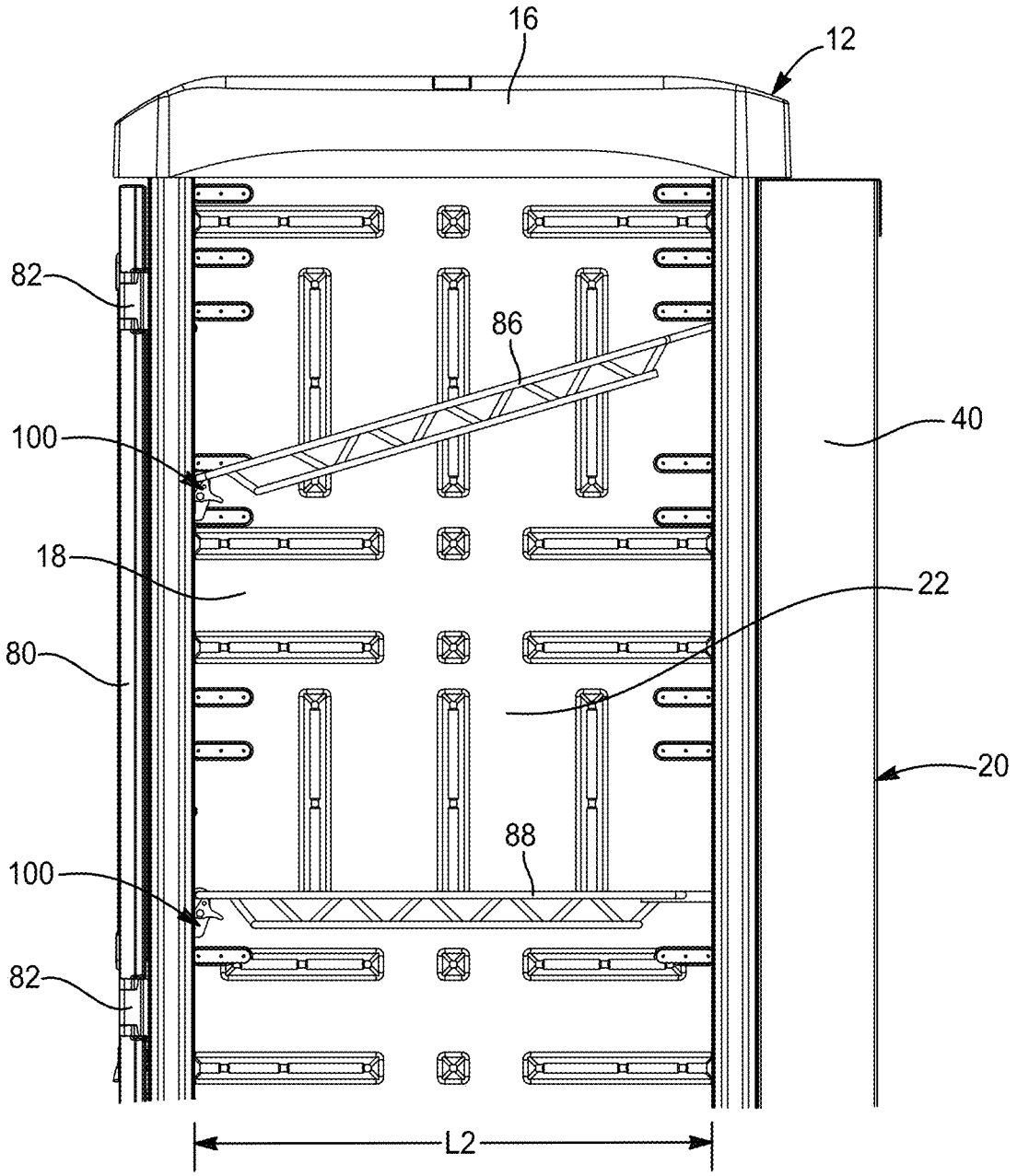
FIG. 12 is an enlarged side section view of the exemplary cabinet assembly shown in FIG. 1 where upper and lower tiltable wire shelves are illustrated.
Figure 13:
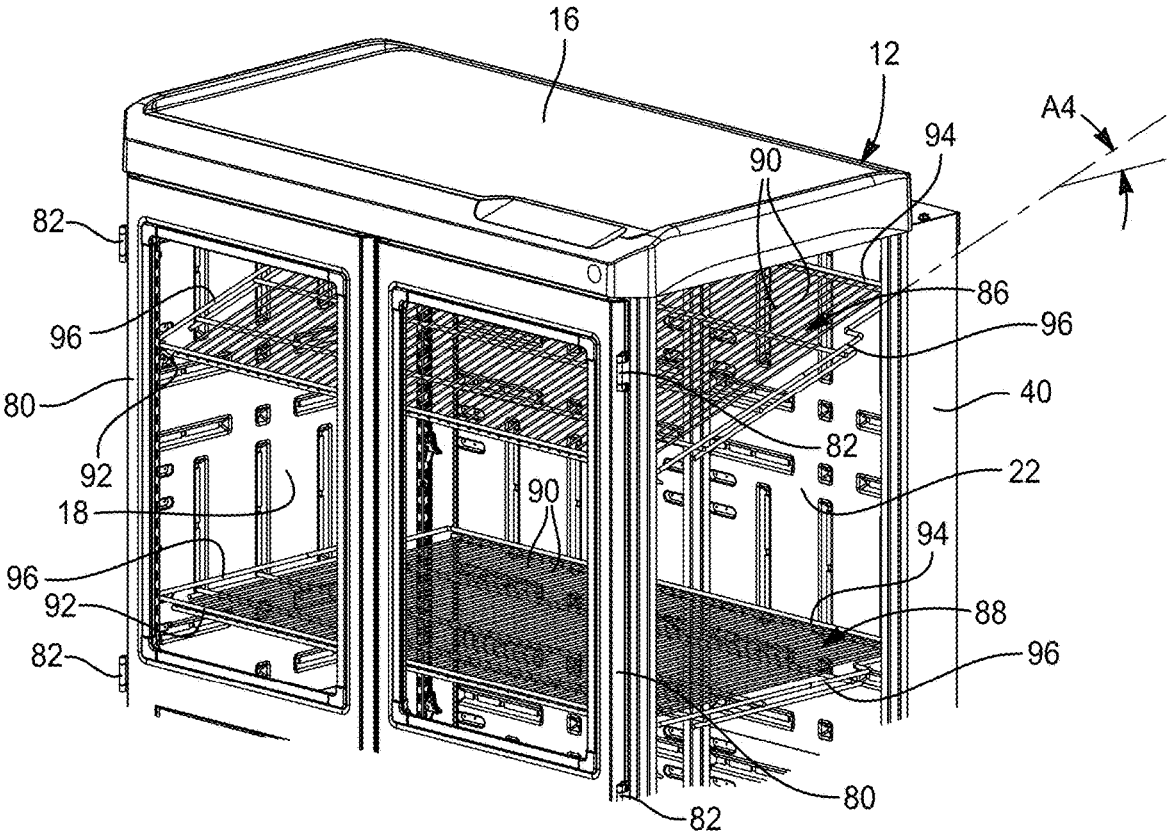
FIG. 13 is an enlarged front perspective view of the exemplary cabinet assembly shown in FIG. 1 where the upper and lower tiltable wire shelves are illustrated.
Figure 14:
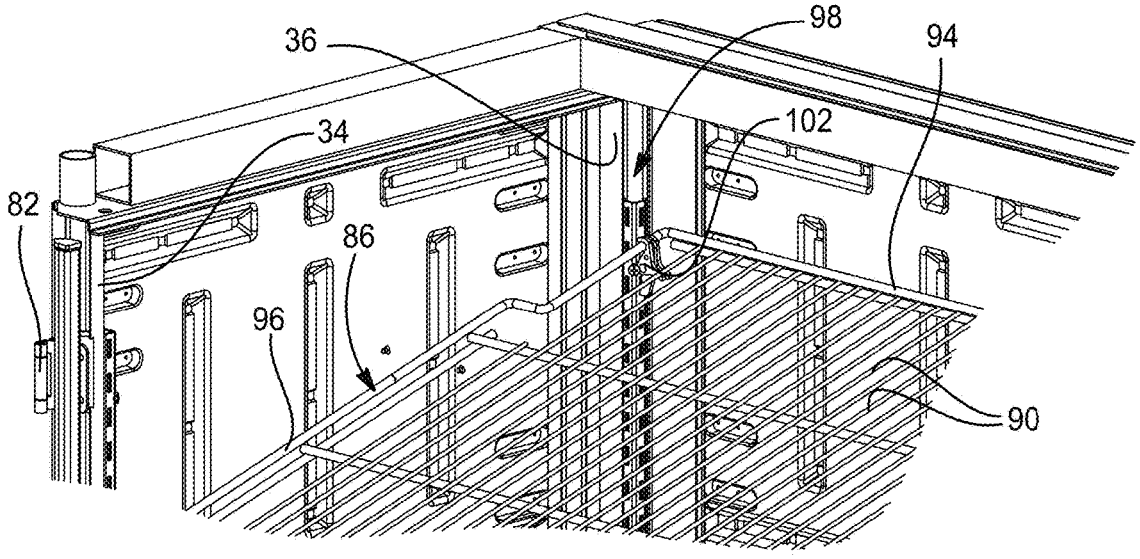
FIG. 14 is an enlarged front perspective view of the exemplary cabinet assembly shown in FIG. 1 where a rear sliding coupling supporting the upper tiltable wire shelf is illustrated.

With reference to FIGS. 12 and 13, the cabinet assembly 10 includes one or more tiltable wire shelves that are mounted in the inner volume 22 of the cabinet body 12. In the illustrated example, two tiltable wire shelves are shown—an upper wire shelf 86 and a lower wire shelf 88. Each of the tiltable wire shelves 86, 88 includes a plurality of crossbars 90 and a perimeter. The perimeter of each wire shelf includes a front bar 92, a rear bar 94, and a pair of side bars 96. When the tiltable wire shelves 86, 88 are installed in the inner volume 22 of the cabinet body, the front bar 92 is positioned near the doors 80 of the cabinet body 12, the rear bar 94 is positioned near the rear wall 20 of the cabinet body 12, and the pair of side bars 96 are positioned near the pair of sides 18 of the cabinet body 12. The pair of side bars 96 extend between the front and rear bars 92 and 94. Each of the side bars 96 has a side bar length L2 that is at least double the bin length L1 such that at least two of the bins 76 fit on each tiltable wire shelf 86, 88 between the front and rear bars 92 and 94 in a front-to-back bin arrangement. In addition, each side bar 96 can have an inward jog or bend as shown in FIG. 14 to accommodate the space limitation within the inner volume 22 of the cabinet body 12 due to the rear corner posts 36.

With additional reference to FIGS. 14-24, the cabinet assembly further includes a shelf mounting system 98 that supports each of the tiltable wire shelves 86, 88 on the cabinet body 12. The shelf mounting system 98 includes one or more pivot couplings 100 disposed between the cabinet body 12 and one of the front and rear bars 92 and 94 of each tiltable wire shelf 86, 88 and one or more sliding couplings 102 between the cabinet body 12 and the pair of side bars 96 of each tiltable wire shelf 86, 88. The orientation of the sliding couplings 102 relative to the cabinet body 12 is 90 degrees apart from the orientation of the pivot coupling 100 relative to the cabinet body 12. The pivot couplings 100 and the sliding couplings 102 cooperate to provide tiltable adjustment for each tiltable wire shelf 86, 88 relative to the cabinet body 12 over a range of angles (e.g., over a range of angles between −20 degrees and +20 degrees). In the illustrated example, the base 14 and the top 16 define two horizontal planes and the lower tiltable wire shelf 88 is arranged parallel to and between the two horizontal planes of the base 14 and the top 16. By contrast, the upper tiltable wire shelf 88 is arranged at a fourth oblique angle A4 relative the horizontal planes defined by the base 14 and the top 16.

The cabinet assembly 10 further includes two forward slotted tracks 104 that extend vertically along and are attached to the two front corner posts 34, and two rearward slotted tracks 106 that extend vertically along and are attached to the two rear corner posts 36 and/or to the sides 14 or the side extensions 40 at locations near the rear wall 20. Each slotted track 104, 106 has a plurality of slots 108 arranged at incremental locations (i.e., at different heights) therealong. In the illustrated embodiment, two pivot couplings 100 support the front bar 92 of each tiltable wire shelf 86, 88. The two pivot couplings 100 are mounted on the two forward slotted tracks 104. The front bar 92 of each tiltable wire shelf 86, 88 is free to pivot (i.e., rotate) relative to the pivot couplings 100, but the front bar 92 does not slide relative to the pivot couplings 100 when the angle of each tiltable wire shelf 86, 88 is adjusted.

Figure 15:
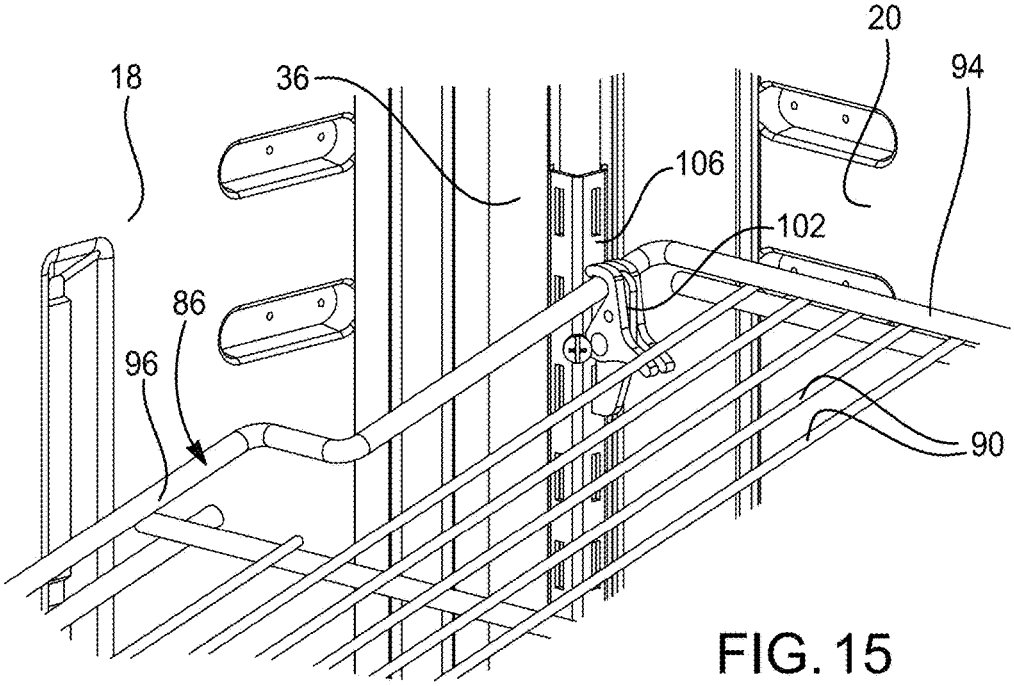
FIG. 15 is an enlarged front perspective view of the rear sliding coupling shown in FIG. 14.
Figure 16:
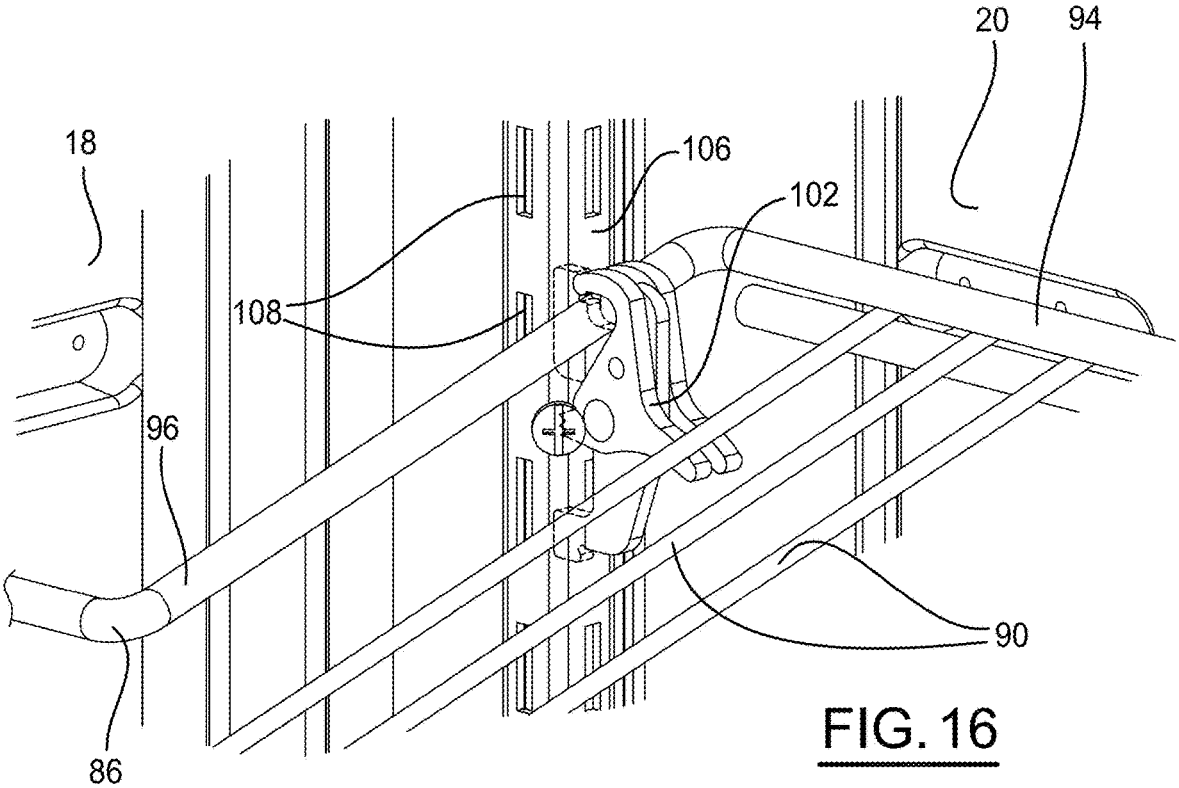
FIG. 16 is another enlarged front perspective view of the rear sliding coupling shown in FIG. 14.
Figure 17:
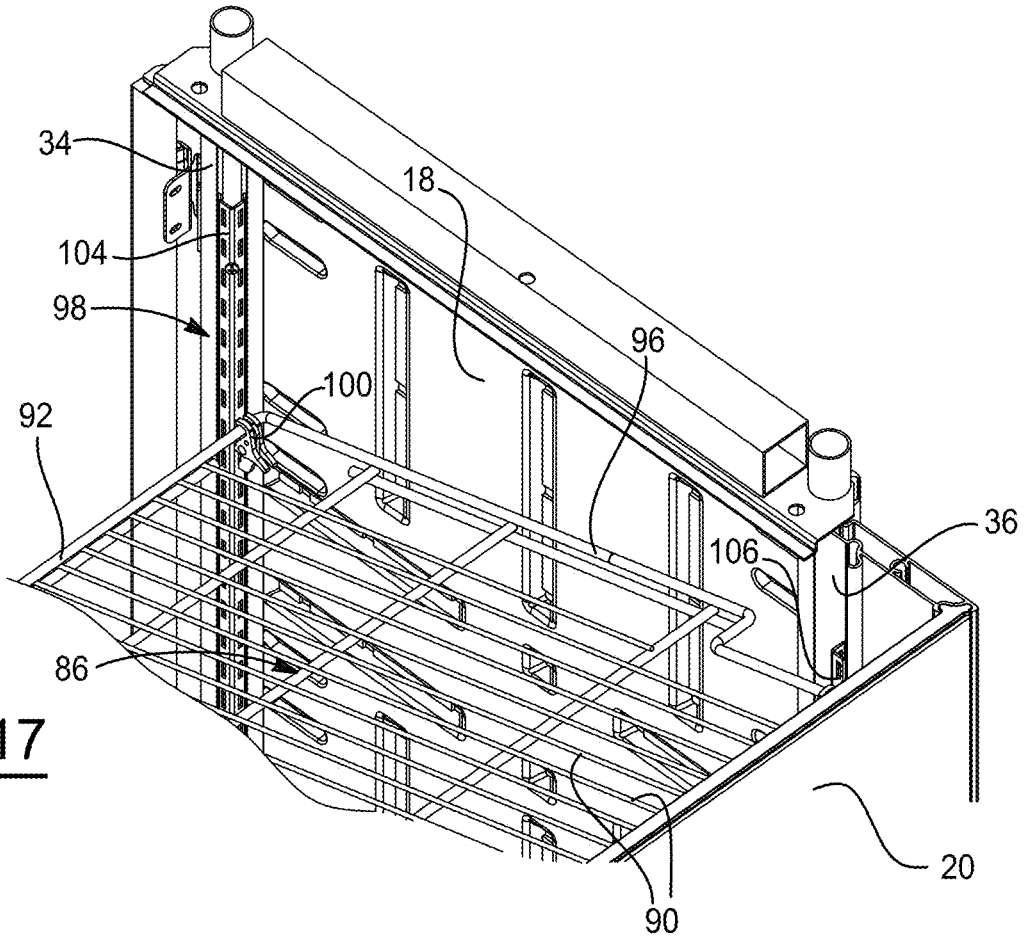
FIG. 17 is a rear perspective view of the exemplary cabinet assembly shown in FIG. 1 where a front pivot coupling supporting the upper tiltable wire shelf is illustrated.
Figure 18:
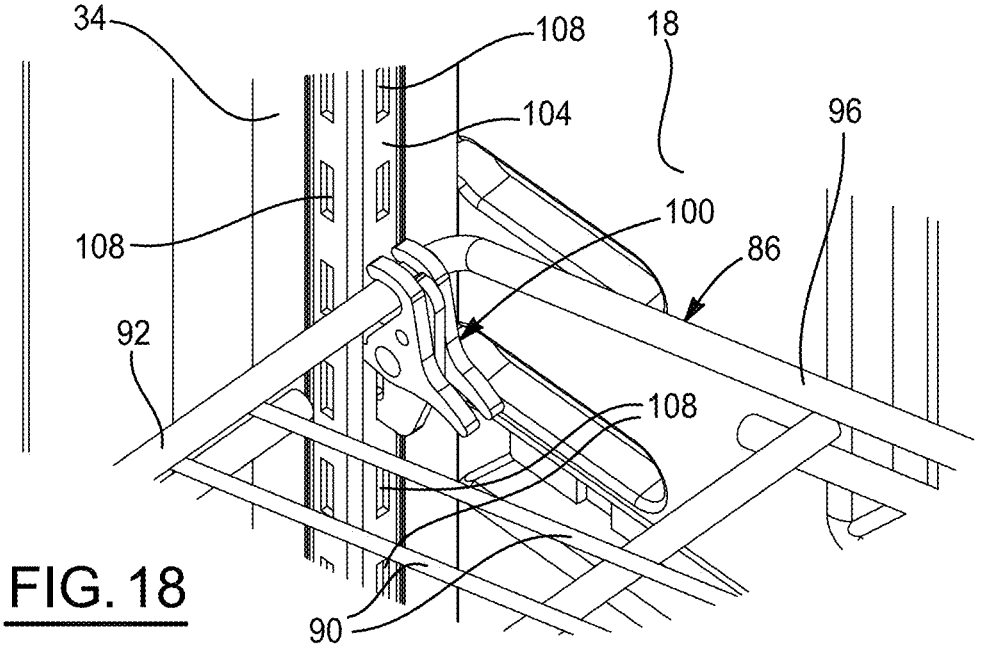
FIG. 18 is an enlarged rear perspective view of the front pivot coupling shown in FIG. 17.
Figure 19:
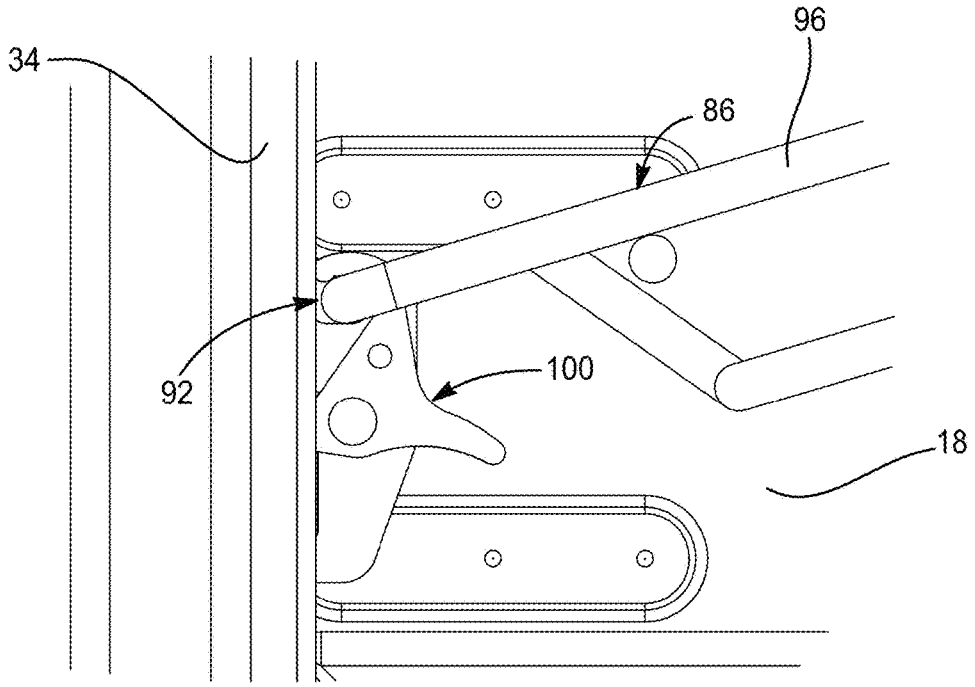
FIG. 19 is an enlarged side elevation view of the front pivot coupling shown in FIG. 17.
Figure 20:
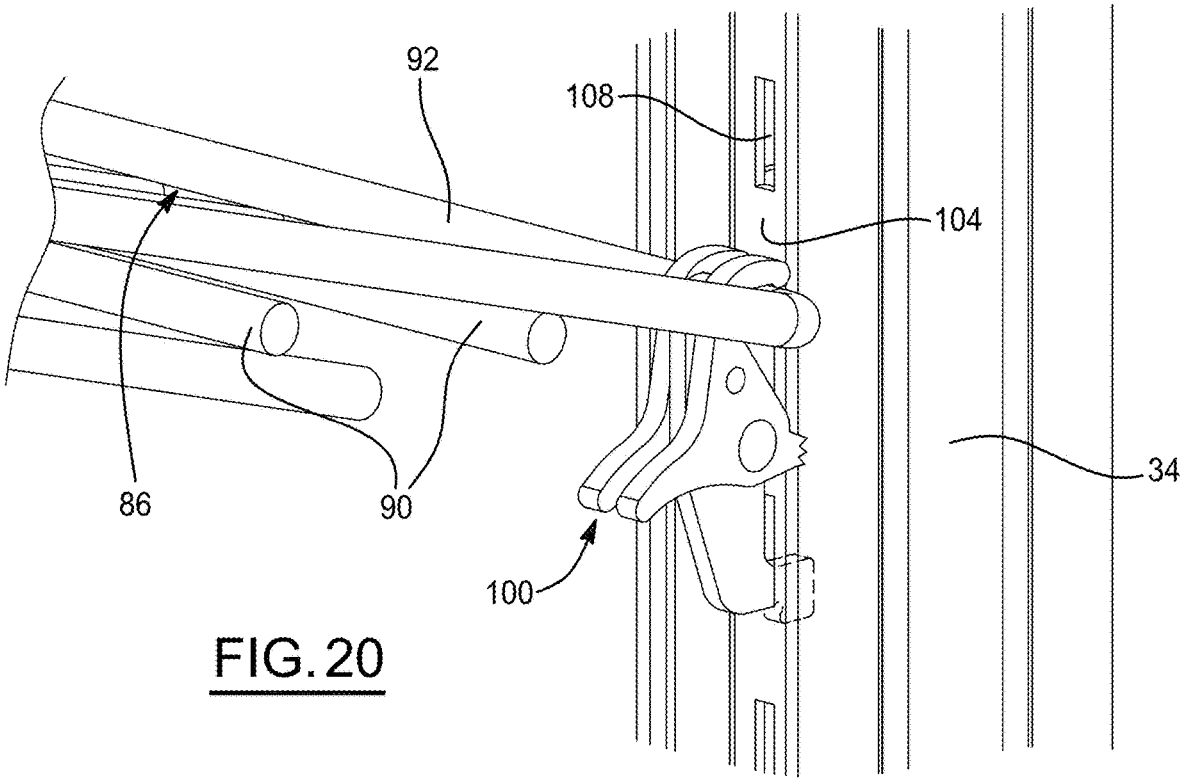
FIG. 20 is another enlarged rear perspective view of the front pivot coupling shown in FIG. 17.
Figure 21:
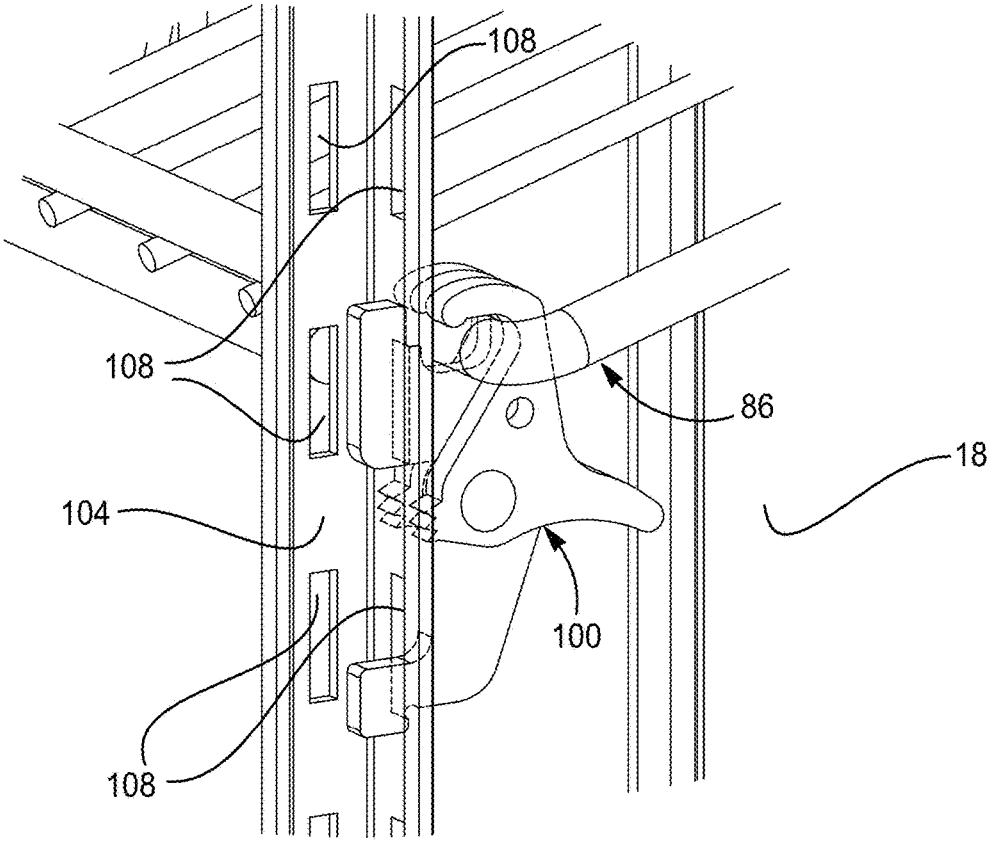
FIG. 21 is an enlarged side perspective view of the front pivot coupling shown in FIG. 17.
Figure 22:
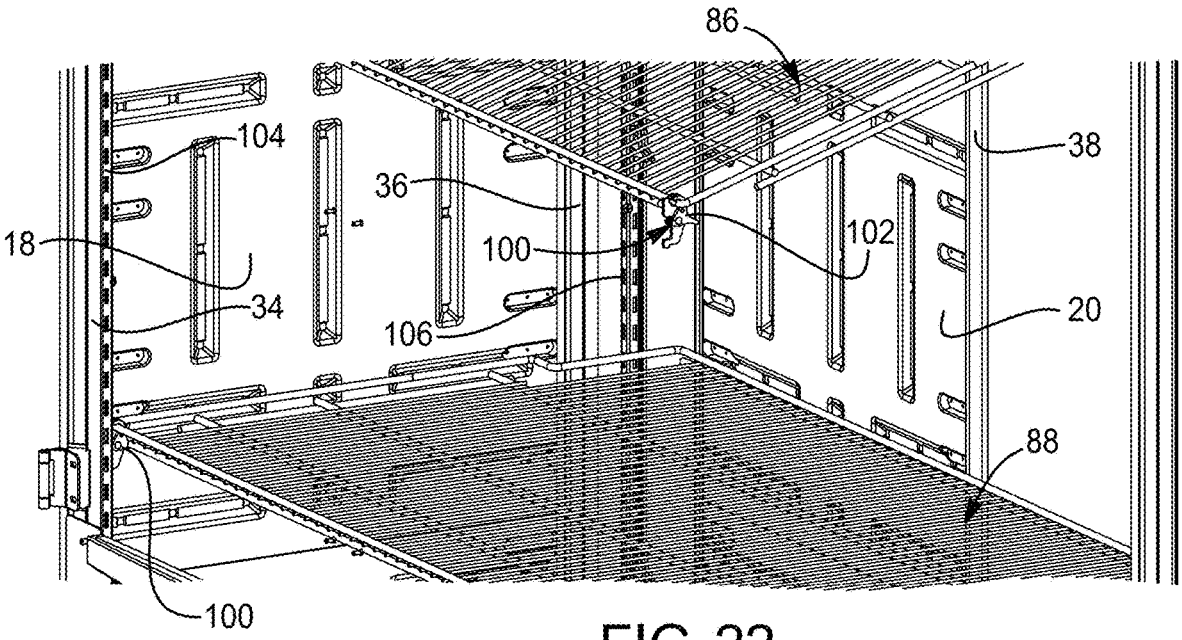
FIG. 22 is a front perspective view of the exemplary cabinet assembly shown in FIG. 1 where the lower tiltable wire shelf is illustrated.
Figure 23:
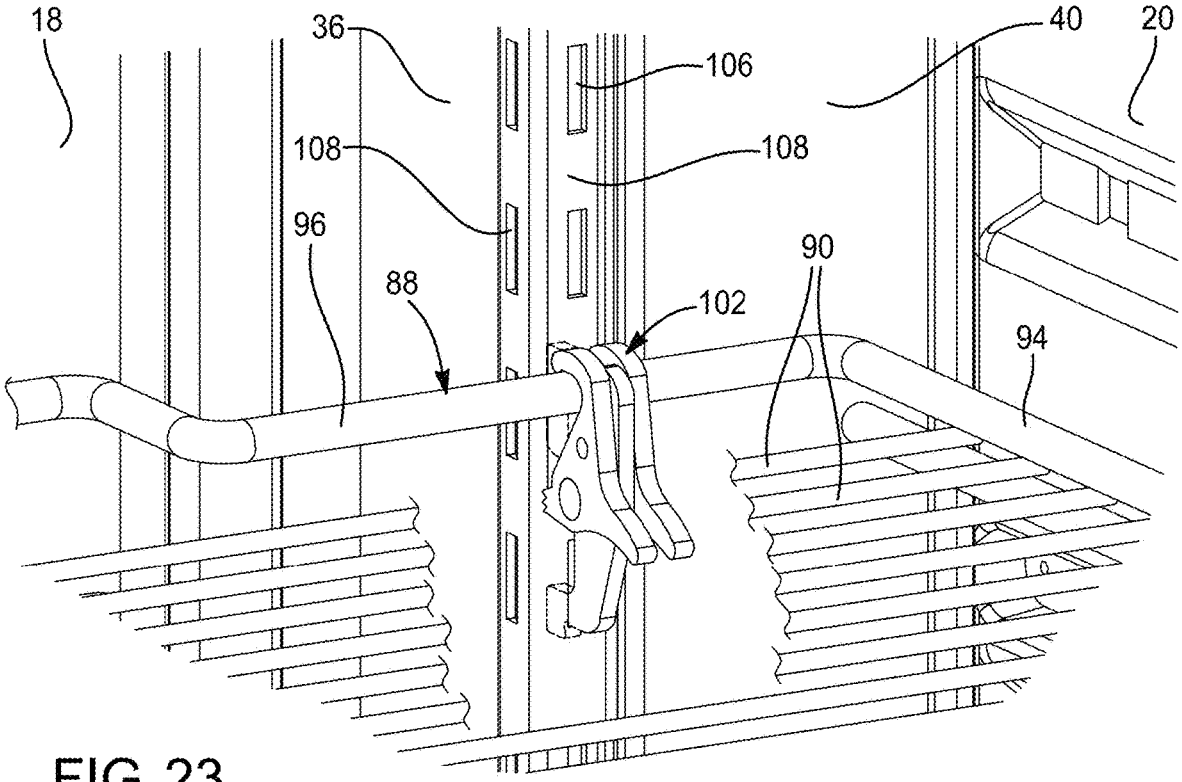
FIG. 23 is an enlarged front perspective view of the rear sliding coupling and the lower tiltable wire shelf shown in FIG. 22.
Figure 24:
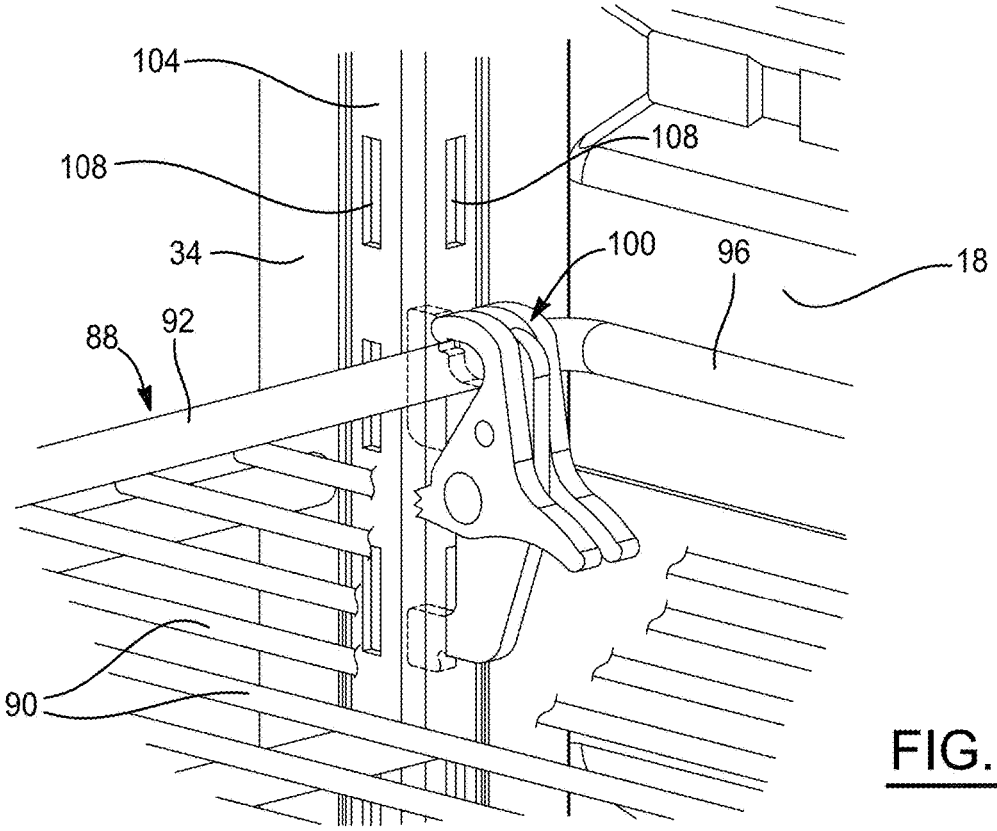
FIG. 24 is an enlarged rear perspective view of the front pivot coupling and the lower tiltable wire shelf shown in FIG. 22.

The side bars 96 of each tiltable wire shelf 86, 88 are supported by two sliding couplings 102 in an area devoid of cross bars. The two sliding couplings 102 are mounted on the two rearward slotted tracks 106. The two pivot couplings 100 can be moved up and down on the two forward slotted tracks 104 and similarly the two sliding couplings 102 can be moved up and down on the two rearward slotted tracks 106. This allows users to configure both the height and the angle of each tiltable wire shelf 86, 88 over a wide range of locations and angles depending upon the number of slots provided in each of the slotted tracks 104, 106. To accommodate varying angles, the side bars 96 of each tiltable wire shelf 86, 88 are free to slide in a fore-aft direction relative to the two sliding couplings 102 while the two sliding couplings 102 remain attached to the two rearward slotted tracks 106. As shown in FIGS. 14-16, the sliding couplings 102 supporting the upper tiltable wire shelf 86 extend around the side bars 96 at locations near the rear bar 94 due to the angled orientation of the upper tiltable wire shelf 86. By contrast, the sliding couplings 102 supporting the lower tiltable wire shelf 88 shown in FIGS. 22 and 23 extend around the side bars 96 at locations closer to the front bar 92 compared to the positions of the sliding couplings 102 shown in FIGS. 14-16 due to the horizontal orientation of the lower tiltable wire shelf 88.

The ability to slide each tiltable wire shelf 86, 88 in the fore-aft direction relative to the sliding couplings 102 is enabled in part by fact that the sliding couplings 102 couple the side bars 96 of the tiltable wire shelves 86, 88 to the cabinet body 12 as opposed to, for example, coupling the front or rear bars 92 or 94 to the cabinet body 12. In addition, the ability to slide each tiltable wire shelf 86, 88 in the fore-aft direction relative to the sliding couplings 102 is enabled by the fact that the rear bar 94 is located rearward of the locations where the sliding couplings 102 connect the tiltable wire shelves 86, 88 to the cabinet body 12 (i.e., the locations of rearward slotted tracks 106) as shown. Further, since the rear center post 38 (to which the rear wall 20 is attached) is located rearward of the rear corner posts 36 (to which the sliding couplings 102 are mounted), there is space to allow fore-aft movement of the tiltable wire shelf 86, 88 without causing interference between the tiltable wire shelf 86, 88 and the rear wall 20.

Figure 25:
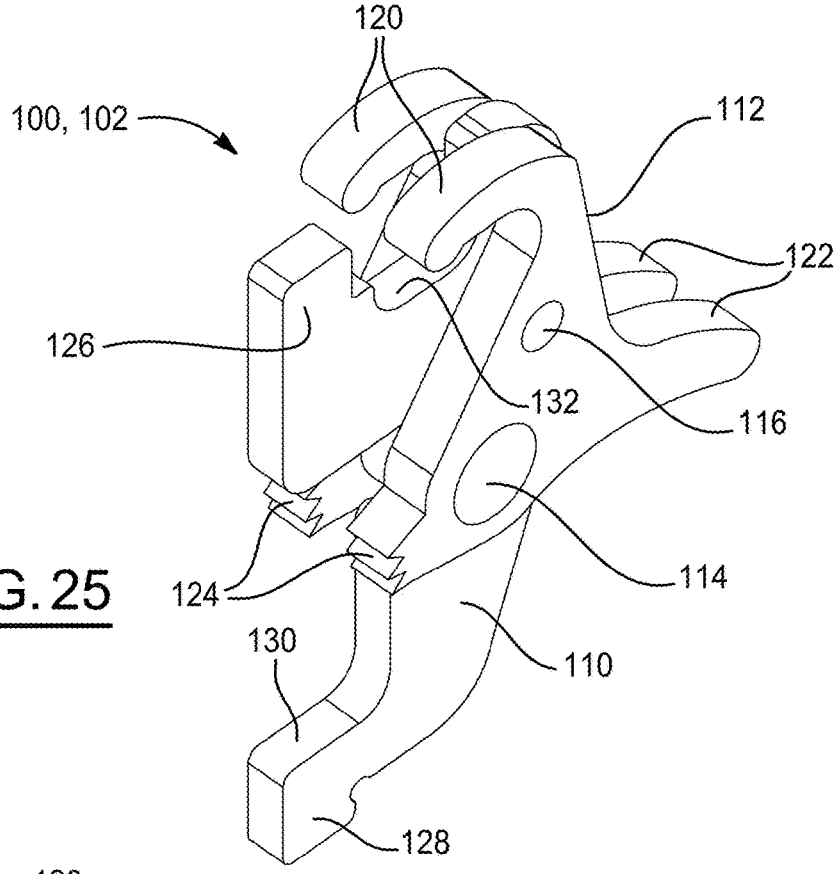
FIGS. 25 and 26 are side perspective views illustrating an exemplary coupler of the sliding couplings and pivot couplings of the cabinet assembly shown in FIG. 1 where a mounting plate and a latch of the coupler are illustrated.
Figure 26:
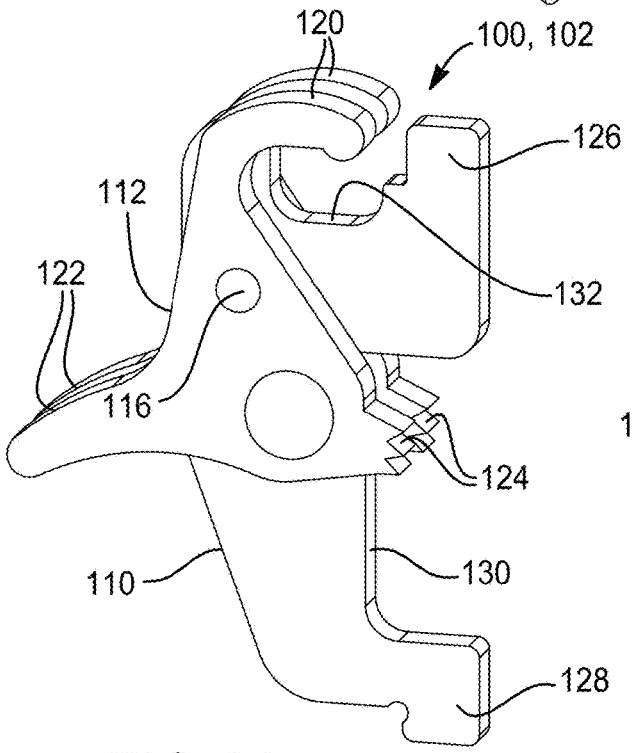
Figure 27:
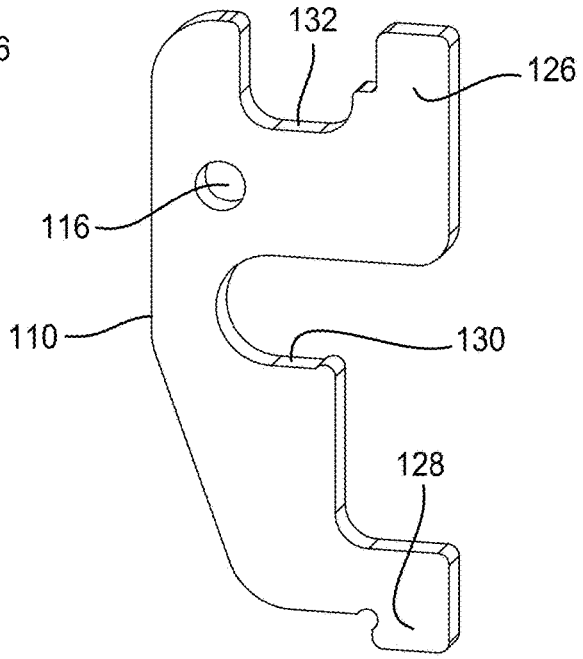
FIG. 27 is a side perspective view of the mounting plate of the exemplary coupler shown in FIGS. 25 and 26.

The pivot couplings 100 and the sliding couplings 102 are provided using a coupler (FIGS. 25 and 26). The coupler used for the pivot couplings 100 is the same as the coupler used for the sliding couplings 102—the only difference is the location of the coupler. The coupler extends around either the front bar 92 or the rear bar 94 of the tiltable wire shelf 86 in the case of the pivot couplings 100, and the coupler extends around one of the side bars 96 of the tiltable wire shelf 86 in the case of the sliding couplings 102.

With reference to FIGS. 25-31, each coupler includes a mounting plate 110, a latch 112, and a pivot (e.g., a pin) 114 that pivotally couples the latch 112 to the mounting plate 110. Both the mounting plate 110 and the latch 112 have a through-bore 116, which is configured to receive a pin that locks the latch 112 in place and prevents the latch 112 from rotating relative to the mounting plate 110.

The latch 112 includes a pair of hook portions 120, a pair of lever portions 122, and two sets of teeth 124. Each lever portion 122 is configured such that the latch 112 will rotate relative to the pivot 114 when pressure is applied to the lever portion 122 by a user to open or close the latch 112. The teeth 124 contact the slotted tracks 104, 106 and provide resistance to rotation that helps prevent the latch 112 from falling open without user actuation.

Figure 29:
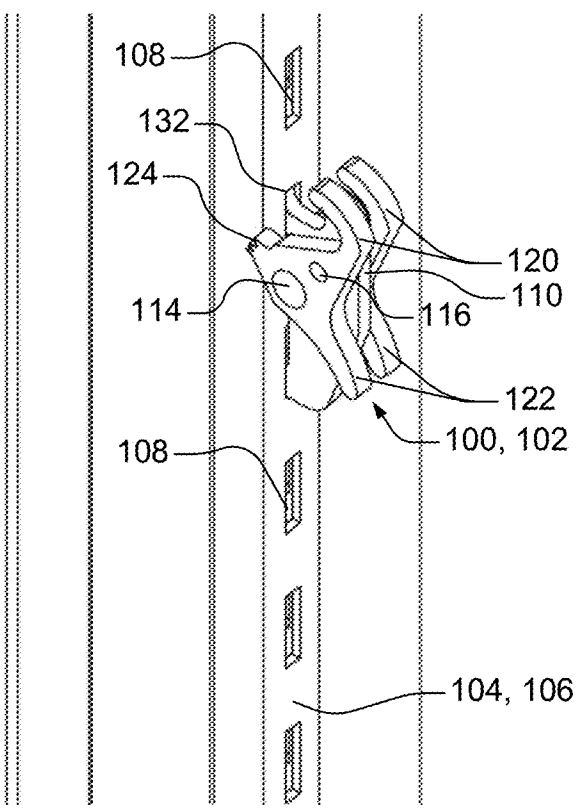
FIGS. 28 and 29 are side perspective views illustrating assembly of the exemplary coupler of FIGS. 25 and 26 to a vertical slotted track.
Figure 28:
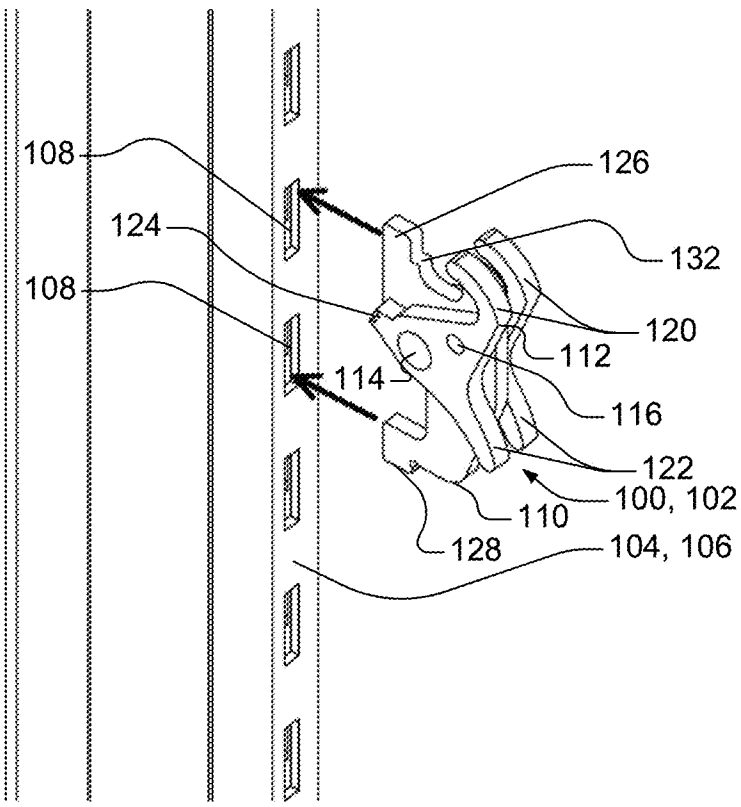

The mounting plate 110 includes an upper tongue 126 and a lower tongue 128 that are spaced apart by an L-shaped slot 130 that receives the pivot 114. The upper and lower tongues 126 and 128 are configured to be inserted into the slots 108 in the slotted tracks 104, 106 as shown in FIGS. 28 and 29. Thus, users can move the coupler up and down on the slotted tracks 104, 106 to any position where there is a slot 108 for the upper tongue 126 and a slot 108 for the lower tongue 128.

Figure 30:
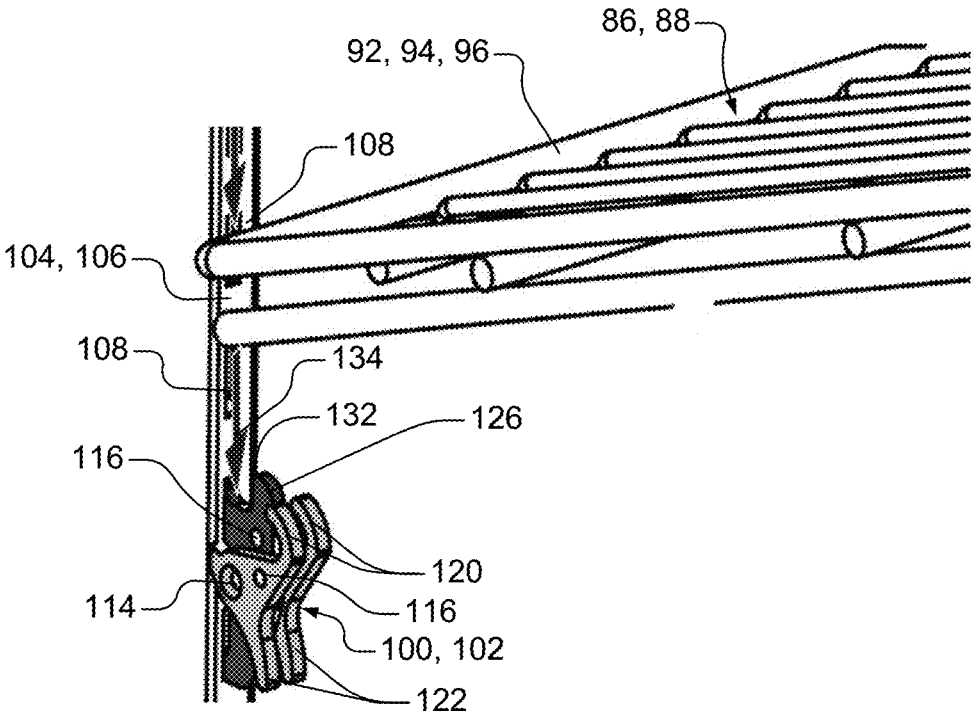
FIGS. 30 and 31 are rear perspective views illustrating assembly of a tiltable wire shelf to the exemplary coupler of FIGS. 25 and 26 while the exemplary coupler is mounted on the vertical slotted track.
Figure 31:
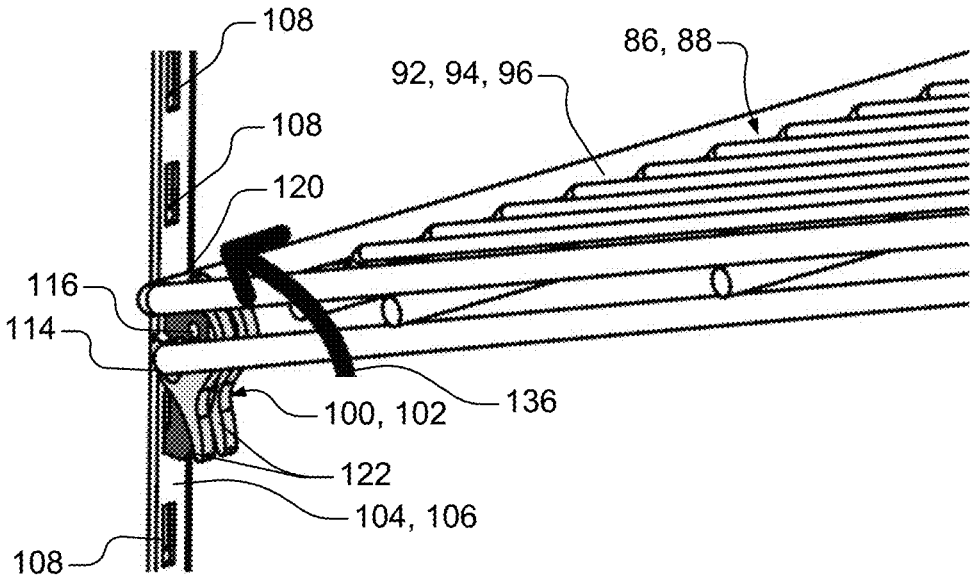

The mounting plate 110 also includes a yoke portion 132. In the case of the pivot couplings 100, the front or rear bar 92 or 94 of the tiltable wire shelf 86 is inserted into the yoke portion 132 of the mounting plate 110 in a first direction 134 as shown in FIG. 30, and the hook portions 120 of the latch 112 swing over the front or rear bar 92 or 94 in a second direction 136 when one or both of the lever portions 122 of the latch 112 is pushed up to close the latch 112 as shown in FIG. 31. When the latch 112 is closed, the front or rear bar 92 or 94 of the tiltable wire shelf 86 is substantially encircled by the hook portions 120 of the latch 120 and the yoke portion 132 of the mounting plate 110. In the case of the sliding couplings 102, the side bar 96 of the tiltable wire shelf 86 is inserted into the yoke portion 132 of the mounting plate 110 in the first direction 134, and the hook portions 120 of the latch 112 swings over the side bar 96 in the second direction 136 when the one or both of the lever portions 122 of the latch 112 is push up to close the latch 112 as shown in FIG. 31. When the latch 112 is closed, the side bar 96 of the tiltable wire shelf 86 is substantially encircled by the hook portions 120 of the latch 120 and the yoke portion 132 of the mounting plate 110.

The foregoing description of the embodiments has been provided for purposes of illustration and description. It is not intended to be exhaustive or to limit the invention. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the invention, and all such modifications are intended to be included within the scope of the invention.

What is claimed is:

1. A cabinet assembly comprising:

a cabinet body having a base, a top, and a first side and a second side that extend between the base and the top to at least partially define an inner volume of the cabinet body, a front post at a front end of each of the first and second sides and a rear post at a rear end of each of the first and second sides, wherein each of the front posts includes a front slotted track extending vertically along the front post and each of the rear posts includes a rear slotted track extending vertically along the rear post, and wherein each of the front and rear slotted tracks includes at least one of a first portion parallel to the first and second sides and a second portion perpendicular to the first and second sides;

at least one tiltable wire shelf mounted in the inner volume of the cabinet body, the at least one tiltable wire shelf including a plurality of crossbars and a perimeter comprising a front bar, a rear bar, and a pair of side bars that extend between the front and rear bars; and a shelf mounting system supporting the at least one tiltable wire shelf on the cabinet body, the shelf mounting system comprising:

a pivot coupling between the cabinet body and one of the front and rear bars of the at least one tiltable wire shelf and a sliding coupling between the cabinet body and one of the side bars of the at least one tiltable wire shelf, the pivot coupling and the sliding coupling cooperating to provide tiltable adjustment of the at least one tiltable wire shelf relative to the cabinet body over a range of angles; and wherein the pivot coupling is received in the second portion of one of the front and rear slotted tracks on one of the first and second sides of the cabinet body and the sliding coupling is received in the first portion of the other of the front and rear slotted tracks on the one of the first and second sides of the cabinet body so that the sliding coupling is oriented 90 degrees from the pivot coupling relative to the one of the first and second sides of the cabinet body, the pivot coupling being positioned between the front and rear posts on the one of the first and second sides of the cabinet body; and wherein at least one side bar of the at least one tiltable wire shelf includes an inward offset portion, the sliding coupling coupled to the at least one side bar along the inward offset portion; and wherein an area of the at least one tiltable wire shelf that is adjacent to the inward offset portion is devoid of any of the plurality of cross bars such that the one side bar is not prohibited from forward and backward sliding engagement with the sliding coupling.

2. The cabinet assembly of claim 1 further comprising at least two bins each having a bin height, a bin width, and a bin length that are sized to fit inside the inner volume of the cabinet body, each of the side bars having a side bar length that is at least double the bin length such that at least two of the bins fit on the at least one tiltable wire shelf between the front and rear bars in a front-to-back bin arrangement.

3. The cabinet assembly of claim 1 wherein the pivot coupling allows the at least one tiltable wire shelf to pivot with respect to the pivot coupling while connecting one of the front and rear bars of the at least one tiltable wire shelf to the cabinet body, and the sliding coupling allows the at least one tiltable wire shelf to slide relative to the sliding coupling while connecting one of the side bars of the at least one tiltable wire shelf to the cabinet body.

4. The cabinet assembly of claim 1 wherein each of the pivot coupling and the sliding coupling includes a mounting plate, a latch, and a pivot that pivotally couples the latch to the mounting plate, the mounting plate being mounted in one of the forward and rearward slotted tracks and supporting the at least one tiltable wire shelf, the latch retaining the at least one tiltable wire shelf in the mounting plate.

5. The cabinet assembly of claim 4 wherein the mounting plate includes an upper tongue, a lower tongue, and a yoke portion, the upper and lower tongues being received in slots in one of the forward and rearward sliding tracks, the yoke portion engaging a bottom surface of one of the front, rear, and side bars to support the at least one tiltable wire shelf.

6. The cabinet assembly of claim 4 wherein the latch includes a hook portion, a lever portion, and teeth, the hook portion extending over a top surface of one of the front, rear, and side bars to retain the at least one tiltable wire shelf in the mounting plate, the lever portion being configured such that the latch rotates about the pivot when pressure is applied to the lever portion, the teeth contacting one of the forward and rearward slotted tracks and providing resistance to rotation of the latch.

7. A cabinet assembly comprising:

a cabinet body defining an inner volume and having a base, a top, and a pair of sides that extend between the base and the top, each of the sides defining a profile between a front edge and a rear edge;

at least one tiltable wire shelf mounted in the inner volume of the cabinet body, the at least one tiltable wire shelf including a plurality of crossbars and a perimeter comprising a front bar, a rear bar, and a pair of side bars that extend between the front and rear bars; and a shelf mounting system supporting the at least one tiltable wire shelf on the cabinet body and enabling adjustment of the at least one tiltable wire shelf over a range of angles relative to the cabinet body, the shelf mounting system comprising a pair of couplings each coupling configured to connect one of the front, rear, and side bars of the at least one tiltable wire shelf to the cabinet body, each coupling including a mounting plate, a latch, and a pivot that pivotally couples the latch to the mounting plate, the mounting plate being mounted to the cabinet body and supporting the at least one tiltable wire shelf, the latch retaining the at least one tiltable wire shelf in the mounting plate; and wherein each of the pair of side bars of the at least one tiltable wire shelf includes an inward offset portion to accommodate the profile defined by a respective side of the cabinet body, each coupling coupled to a respective one of the pair of side bars along the inward offset portion; and wherein an area of the at least one tiltable wire shelf that is near the inward offset portion is devoid of any of the plurality of cross bars so as to allow sliding movement of the side bar along the coupling and enable tiltable adjustment of the at least one tiltable wire shelf.

8. The cabinet assembly of claim 7 wherein the mounting plate includes an upper tongue, a lower tongue, and a yoke portion, the upper and lower tongues being received in slots in one of the forward and rearward sliding tracks, the yoke portion engaging a bottom surface of one of the front, rear, and side bars to support the at least one tiltable wire shelf.

9. The cabinet assembly of claim 7 wherein the latch includes a hook portion, a lever portion, and teeth, the hook portion extending over a top surface of one of the front, rear, and side bars to retain the at least one tiltable wire shelf in the mounting plate, the lever portion being configured such that the latch rotates about the pivot when pressure is applied to the lever portion, the teeth contacting one of the forward and rearward slotted tracks and providing resistance to rotation of the latch.

10. The cabinet assembly of claim 7 wherein the the pair of couplings includes a pivot coupling configured to connect one of the front and rear bars of the at least one tiltable wire shelf to the cabinet body and a sliding coupling configured to connect one of the side bars of the at least one tiltable wire shelf to the cabinet body, and wherein the orientation of the sliding coupling relative to the cabinet body is 90 degrees apart from the orientation of the pivot coupling relative to the cabinet body.

11. The cabinet assembly of claim 10 wherein the pivot coupling allows the at least one tiltable wire shelf to pivot with respect to the pivot coupling while connecting one of the front and rear bars of the at least one tiltable wire shelf to the cabinet body, and the sliding coupling allows the at least one tiltable wire shelf to slide relative to the sliding coupling while connecting one of the side bars of the at least one tiltable wire shelf to the cabinet body.

12. A cabinet assembly comprising:

a cabinet body defining an inner volume and having a base, a top, a pair of sides, and a rear wall, the sides and the rear wall extending between the base and the top, each of the sides having a profile between a front edge and a rear edge, the rear wall including a pair of rear panels that are disposed adjacent to one another in a direction extending between the sides, each of the rear panels having an inner edge and an outer edge, the cabinet body including a front corner post, a rear corner post, and a rear center post, the front corner posts being arranged along and connected to the front edges of each side, the rear corner posts being arranged along and connected to the rear edges of each side, the rear corner posts also being arranged along and connected to outer edges of the rear panels, the corner posts being arranged along and connected to the inner edge of each rear panel, the front and rear corner posts extending vertically between the base and the top and therefore act as a load bearing frame of the cabinet body, the center post extending into the base and therefore contributing to the rigidity of the cabinet body;

at least one tiltable wire shelf mounted in the inner volume of the cabinet body, the at least one tiltable wire shelf including a plurality of crossbars and a perimeter comprising a front bar, a rear bar, and a pair of side bars that extend between the front and rear bars;

a shelf mounting system supporting the at least one tiltable wire shelf on the cabinet body and enabling adjustment of the at least one tiltable wire shelf over a range of angles relative to the cabinet body, the shelf mounting system comprising a pair of first couplings each configured to connect one of the front, rear, and side bars of the at least one tiltable wire shelf to the cabinet body and a pair of second couplings configured to connect to another of the front, rear, and side bars of the at least one tiltable wire shelf, the first couplings being oriented 90 degrees relative to the second couplings;

wherein each of the pair of side bars of the at least one tiltable wire shelf includes an inwardly positioned offset portion which adapts to the profile of a respective one of the sides of the cabinet body;

wherein each first coupling is coupled to a respective side bar of the pair of side bars of the at least one tiltable wire shelf at the inwardly positioned offset portion of the respective side bar such that the respective side bar is not prohibited from forward and backward sliding movement in the first coupling while the coupling remains coupled to the respective side bar;

wherein each second coupling is coupled to one of the front and rear bars of the at least one tiltable wire shelf such that the one of the front and rear bars is not prohibited from pivotal movement in the second coupling.

13. The cabinet assembly of claim 12 wherein the front corner posts, the rear corner posts, and the rear center post are interchangeable.

14. The cabinet assembly of claim 12 wherein each of the front corner posts, the rear corner posts, and the rear center post includes a cylindrical body and at least three ribs projecting radially outward from the cylindrical body to define curved channels therebetween, the curved channels receiving one of the front edges of the sides, the rear edges of the sides, and the inner edges of the rear panels.

15. The cabinet assembly of claim 14 wherein each side includes a flat panel portion and flange portions disposed at the front and rear edges thereof, each rear panel includes a flat panel portion and flange portions disposed at the inner and outer edges thereof, the curved channels in the front and rear corner posts are configured to the receive the flange portions of the sides, and the curved channels in the rear center post are configured to receive the flange portions of the rear panels.

16. The cabinet assembly of claim 15 wherein each flange portion of each side includes a curved wall oriented at an oblique angle with respect to the flat panel portion of each side, and each flange portion of each rear panel includes a curved wall oriented at an oblique angle with respect to the flat panel portion of each rear panel.

* * * * *